US011247483B2

(12) United States Patent
Shibata

(10) Patent No.: US 11,247,483 B2
(45) Date of Patent: Feb. 15, 2022

(54) IMAGE FORMING APPARATUS AND METHOD, ABNORMAL NOZZLE DETECTION METHOD, AND PRINTED MATTER MANUFACTURING METHOD

(71) Applicant: FUJIFILM Corporation, Tokyo (JP)

(72) Inventor: Hiroyuki Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 17/031,007

(22) Filed: Sep. 24, 2020

(65) Prior Publication Data

US 2021/0001638 A1 Jan. 7, 2021

Related U.S. Application Data

(63) Continuation of application No. PCT/JP2019/012377, filed on Mar. 25, 2019.

(30) Foreign Application Priority Data

Mar. 28, 2018 (JP) ..... JP2018-062724

(51) Int. Cl.
*B41J 2/21* (2006.01)
*B41J 2/045* (2006.01)

(52) U.S. Cl.
CPC ..... *B41J 2/2142* (2013.01); *B41J 2/0451* (2013.01); *B41J 2/04508* (2013.01); *B41J 2/04586* (2013.01)

(58) Field of Classification Search
CPC .. B41J 2/0451; B41J 2/04536; B41J 2/04586; B41J 2/04508; B41J 2/2142
See application file for complete search history.

(56) References Cited

U.S. PATENT DOCUMENTS 6,707,954 B1 * 3/2004 Akamatsu ..... G06K 9/46 382/286
2004/0252148 A1 12/2004 Shibata et al.
(Continued)

FOREIGN PATENT DOCUMENTS

JP 4018598 B2 12/2007
JP 2010-188663 A 9/2010
(Continued)

OTHER PUBLICATIONS

International Search Report dated May 7, 2019 in International Application No. PCT/JP2019/012377.
(Continued)

*Primary Examiner* — Thinh H Nguyen
(74) *Attorney, Agent, or Firm* — Sughrue Mion, PLLC

(57) ABSTRACT

Provided is an image forming apparatus and a method, an abnormal nozzle detection method, and a printed matter manufacturing method that can suppress the consumption of an extra medium and can efficiently specify an abnormal nozzle. The image forming apparatus (10) includes a print head (16) that has a plurality of nozzles, an association unit (40) that associates the nozzle with a partial region in a user image, a first correction unit that performs a first correction assuming that the associated nozzle is abnormal in at least one of the partial regions, a streak detection unit (44) that detects streak information from a print result of the user image including the partial region subjected to the first correction, and a nozzle state estimation unit (46) that estimates a state of the nozzle on the basis of the streak information of two or more partial regions in a single user image.

24 Claims, 19 Drawing Sheets

(56) References Cited

U.S. PATENT DOCUMENTS

| | | | |
|---|---|---|---|
| 2005/0134623 | A1 | 6/2005 | Mizes |
| 2010/0207983 | A1 | 8/2010 | Sasayama |
| 2011/0063354 | A1 | 3/2011 | Enge |
| 2011/0227988 | A1 | 9/2011 | Yamazaki |
| 2014/0232772 | A1 | 8/2014 | Sasaki et al. |
| 2014/0347417 | A1 | 11/2014 | Murayama et al. |
| 2016/0292526 | A1 | 10/2016 | Ukishima |
| 2017/0177962 | A1 | 6/2017 | Yamazaki |
| 2017/0274690 | A1 | 9/2017 | Ukishima |
| 2017/0282535 | A1 | 10/2017 | Shibata |

FOREIGN PATENT DOCUMENTS

| | | | |
|---|---|---|---|
| JP | 2014-159139 | A | 9/2014 |
| JP | 2015-003515 | A | 1/2015 |
| JP | 5725597 | B2 | 5/2015 |
| JP | 2016-060191 | A | 4/2016 |
| JP | 5971151 | B2 | 8/2016 |
| JP | 2016-193504 | A | 11/2016 |
| JP | 2017-177441 | A | 10/2017 |
| JP | 2017-181094 | A | 10/2017 |

OTHER PUBLICATIONS

Written Opinion of the International Searching Authority dated May 7, 2019 in International Application No. PCT/JP2019/012377.
International Preliminary Report on Patentability dated Sep. 29, 2020 in International Application No. PCT/JP2019/012377.

* cited by examiner

IMAGE FORMING APPARATUS AND METHOD, ABNORMAL NOZZLE DETECTION METHOD, AND PRINTED MATTER MANUFACTURING METHOD

CROSS-REFERENCE TO RELATED APPLICATIONS

The present application is a Continuation of PCT International Application No. PCT/JP2019/012377 filed on Mar. 25, 2019 claiming priority under 35 U.S.C § 119(a) to Japanese Patent Application No. 2018-062724 filed on Mar. 28, 2018. Each of the above applications is hereby expressly incorporated by reference, in its entirety, into the present application.

BACKGROUND OF THE INVENTION

1. Field of the Invention

The present invention relates to an image forming apparatus and a method, an abnormal nozzle detection method, and a printed matter manufacturing method, and more particularly to a technique and a correction technique for detecting an abnormal nozzle of a print head in inkjet printing.

2. Description of the Related Art

In the field of digital printing, a single-pass inkjet printing apparatus has been put into practical use. The single-pass inkjet printing apparatus completes image formation by one relative scanning (one pass) with respect to a medium such as paper by using a print head in which a large number of nozzles are disposed at high density. In such an inkjet printing apparatus, in a case where an ejection abnormality such as ejection disability or ejection bending occurs in the nozzle of the print head, a corresponding portion of a printed image becomes a streak, and thus there is a problem that printing quality is significantly impaired.

As a technique for detecting such streaks, for example, image inspection methods disclosed in JP2016-193504A and JP2017-181094A are known. In addition, as a technique for correcting streaks due to an abnormality in the nozzle, there are, for example, correction techniques disclosed in JP4018598B and JP2010-188663A. An inkjet printing apparatus disclosed in JP4018598B comprises a correction unit that, in a case where there is a nozzle with a defective ejection state, performs subtraction processing on multi-value data of pixels corresponding to the nozzle with the defective ejection state and pixels in the vicinity thereof, and performs addition processing of an amount corresponding to subtraction processing on multi-value data of pixels corresponding to other nozzles capable of recording a recording position by the nozzle with the defective ejection state and pixels in the vicinity thereof, and then binarizes the multi-value data of the pixels. "Defective" in JP4018598B is a term corresponding to "abnormal" in the present specification. By adopting such a correction technique, it is possible to make streaks due to the abnormality of the nozzle invisible.

However, in order to perform the corrections disclosed in JP4018598B and JP2010-188663A, it is necessary to accurately specify a nozzle in which an abnormality has occurred. In recent print heads, since the nozzles are disposed at high density and the same region is printed by a plurality of nozzles, it is difficult to specify an abnormal nozzle. Therefore, with the streak detection techniques disclosed in JP2016-193504A and JP2017-181094A, even in a case where the streak can be specified from the image, the abnormal nozzle that causes the streak cannot be specified, and thus the streak cannot be immediately corrected.

To solve this problem, for example, as disclosed in JP5725597B, a nozzle check pattern is output separately from the user image to specify the abnormal nozzle. However, in order to output the nozzle check pattern, it is necessary to consume a certain region on paper or another medium, which is not desirable from the viewpoint of effective utilization of the medium and the cost of the medium. In addition, in a case where a printed matter is processed in a subsequent step, a step of removing a region on the medium on which the nozzle inspection pattern is printed is required, which is not desirable from the viewpoint of workability and/or productivity.

As another technique for specifying an abnormal nozzle, as disclosed in JP5971151B and JP2017-177441A, a method has been proposed in which, assuming an abnormal nozzle, the nozzle disabled for ejection is changed and a streak correction method is tried a plurality of times.

SUMMARY OF THE INVENTION

JP5971151B and JP2017-177441A disclose a method of printing a plurality of sheets in which correction is performed by changing the nozzle disabled for ejection, and specifying an abnormal nozzle in a plurality of user image regions. The techniques disclosed in JP5971151B and JP2017-177441A may not necessarily occupy a certain region other than the user image region in order to specify an abnormal nozzle.

However, JP5971151B and JP2017-177441A disclose only a method of specifying an abnormal nozzle by using a plurality of pages, and streaks cannot always be efficiently corrected.

In addition, in JP5971151B and JP2017-177441A, since a case in which there is an existing abnormal nozzle or the like is not taken into consideration in a streak generating region, there are a case in which the abnormal nozzle cannot always be specified, and a case in which streaks are generated by specifying processing, and there is a problem that streaks cannot be appropriately corrected, or a problem that waste paper is increased.

That is, in the related art, even in a case where a streak can be detected from a printed matter, there is no means for efficiently specifying an abnormal nozzle from a single image (one page image), and appropriately correcting the streaks without increasing waste paper.

The present invention has been made in view of such circumstances, and an object of the present invention is to provide an image forming apparatus and a method, an abnormal nozzle detection method, and a printed matter manufacturing method that can suppress the consumption of an extra medium and can efficiently specify an abnormal nozzle in order to provide a means for solving at least one of the above-described problems.

Further, another object of the present invention includes providing a technique capable of detecting streaks and specifying abnormal nozzles and performing correction in response to the abnormal nozzles without increasing waste paper.

An image forming apparatus according to the first aspect of the present disclosure comprising: a print head that has a plurality of nozzles for ejecting a liquid droplet; an association unit that associates the nozzle with a partial region in a user image designated as an image of a target whose image is formed by using the print head; a first correction unit that performs a first correction assuming that the associated nozzle is abnormal in at least one of the partial regions; a printing control unit that causes the print head to print the user image including the partial region subjected to the first correction; a streak detection unit that detects streak information from a print result of the user image including the partial region subjected to the first correction; and a nozzle state estimation unit that estimates a state of the nozzle on the basis of the streak information of two or more partial regions in a single user image printed by using the print head.

According to the first aspect, the partial region subjected to the first correction can be a region in which the streak is invisible due to an effect of the first correction. In a case where the user image including the partial region subjected to the first correction is output, unless a nozzle with an ejection abnormality is newly generated in the print head, the print result can be a good output substantially without streaks.

On the other hand, assuming that the user image including the partial region subjected to the first correction is output, in a case where an abnormality occurs in the nozzle of the print head and a nozzle assumed to be abnormal in any partial region and/or a nozzle used for the correction becomes an abnormal nozzle, an effect of the first correction collapses in the partial region and streaks are generated. Therefore, from the streak information detected by the streak detection unit, it is possible to estimate a state of the nozzle on the basis of a relationship between the partial region in which the streak is generated and the corresponding nozzle. For example, the nozzle state estimation unit can specify, from the streak information detected by the streak detection unit, the abnormal nozzle by performing evaluation such as which partial region in the single user image has streaks and/or what kind of streak occurs.

The image forming apparatus according to the second aspect further comprises, in the first aspect, a second correction unit that performs a second correction that suppresses visibility of streaks due to an abnormal nozzle having an ejection abnormality on the basis of the state of the nozzle estimated by the nozzle state estimation unit.

According to the second aspect, it is possible to specify the abnormal nozzle causing the streaks at an early stage and perform the second correction, and thus it is possible to suppress waste paper. For the first correction and the second correction, the same correction method may be applied or different correction methods may be applied.

The image forming apparatus according to the third aspect can be configured such that, in the second aspect, the second correction unit disables the abnormal nozzle for ejection and performs the second correction by using a nozzle near the abnormal nozzle.

The image forming apparatus according to the fourth aspect further comprises, in the third aspect, an information storage unit that stores an abnormal nozzle mask file that describes information on the abnormal nozzle disabled for ejection, in which the abnormal nozzle mask file is updated in a case where the abnormal nozzle is newly specified by the nozzle state estimation unit.

According to the fourth aspect, it is possible to grasp information on the existing abnormal nozzle by using the abnormal nozzle mask file. In addition, it is possible to appropriately select combinations of nozzles in the partial region subjected to the first correction on the basis of the information on the abnormal nozzle mask file.

The image forming apparatus according to the fifth aspect can be configured such that, in the second aspect, a plurality of heads that is capable of printing in the same region is provided as the print head, the nozzle used for printing each pixel is selected by using a nozzle distribution mask pattern file that defines which nozzle of the plurality of heads is used to print each pixel, and the second correction unit performs the second correction by updating the nozzle distribution mask pattern file.

The plurality of heads capable of printing at the same pixel position may be heads that eject droplets of ink having the same color.

The image forming apparatus according to the sixth aspect can be configured such that, in the second aspect, the second correction unit replaces a color of an abnormal nozzle determined to be abnormal by the nozzle state estimation unit with a different color and performs the second correction by using another nozzle of the different color.

The image forming apparatus according to the seventh aspect can be configured such that, in any one aspect of the first aspect to the sixth aspect, the association unit divides a single region of the user image into a plurality of the partial regions, and associates the nozzle with each of the divided partial regions.

The image forming apparatus according to the eighth aspect can be configured such that, in any one aspect of the first aspect to the sixth aspect, among the plurality of nozzles, a combination of the nozzles that is assumed to be abnormal in the partial region is a combination determined in advance by satisfying a condition that streaks are not generated by performing the first correction.

According to the eighth aspect, it is possible to perform the first correction on a partial region at an appropriate portion in which streak is not generated in consideration of the correction state for the existing abnormal nozzle.

The image forming apparatus according to the ninth aspect can be configured such that, in any one aspect of the first aspect to the eighth aspect, among the plurality of nozzles, a combination of the nozzles that is assumed to be abnormal in the partial region is a combination of the nozzles determined that there are no streaks in a streak inspection performed in advance.

The image forming apparatus according to the tenth aspect can be configured such that, in the ninth aspect, the determination that there are no streaks is made by using a chart printed separately from the user image.

The image forming apparatus according to the eleventh aspect can be configured such that, in any one aspect of the first aspect to the eighth aspect, among the plurality of nozzles, a combination of the nozzles that is assumed to be abnormal in the partial region is set according to information on the abnormal nozzle already specified and a rule defined in advance.

According to the eleventh aspect, it is possible to perform the first correction on a partial region at an appropriate portion in which streak is not generated in consideration of the influence of the second correction for the existing abnormal nozzle.

The image forming apparatus according to the twelfth aspect can be configured such that, in any one aspect of the first aspect to the eleventh aspect, the nozzle state estimation unit uses density information of an input image representing the user image for the estimation, and lowers a degree of contribution to the estimation with respect to a region having a relatively low image density in the input image.

A gradation value of each pixel of the input image can be density information.

The image forming apparatus according to the thirteenth aspect can be configured such that, in any one aspect of the first aspect to the twelfth aspect, the nozzle state estimation unit estimates the state of the nozzle by using information indicating an intensity of a streak.

The image forming apparatus according to the fourteenth aspect can be configured such that, in any one aspect of the first aspect to the thirteenth aspect, the nozzle state estimation unit estimates a correction state in addition to estimation of the state of the nozzle.

The estimation of the correction state includes, for example, determining whether or not a correction value is appropriate.

The image forming apparatus according to the fifteenth aspect can be configured such that, in any one aspect of the first aspect to the fourteenth aspect, the nozzle state estimation unit determines that the correction nozzle is abnormal in a case where streaks are generated in the plurality of partial regions that shares a correction nozzle used for a correction of the assumed abnormal nozzle in the first correction.

The image forming apparatus according to the sixteenth aspect can be configured such that, in any one aspect of the first aspect to the fifteenth aspect, in a case where there are no streaks in a specific partial region subjected to the first correction and there are streaks in the partial region subjected to the first correction other than the specific partial region, the nozzle state estimation unit determines that the nozzle assumed to be abnormal in the specific partial region actually becomes abnormal.

The image forming apparatus according to the seventeenth aspect can be configured such that, in any one aspect of the first aspect to the sixteenth aspect, a combination of the nozzles associated with the partial region is changed in a case where the nozzle state estimation unit cannot specify an abnormal nozzle.

The image forming apparatus according to the eighteenth aspect can be configured such that, in any one aspect of the first aspect to the seventeenth aspect, the assumed abnormal nozzle in the first correction unit is set to different partial regions in different colors.

The image forming apparatus according to the nineteenth aspect can be configured such that, in any one aspect of the first aspect to the eighteenth aspect, a plurality of heads that has a common structure is provided as the print head, and the partial regions in which the assumed abnormal nozzle in the first correction unit is set for each of the plurality of heads are set at dispersed positions in the user image.

The image forming apparatus according to the twentieth aspect can be configured such that, in any one aspect of the first aspect to the nineteenth aspect, the first correction unit performs processing of embedding a correction pattern subjected to the first correction in the partial region in the user image.

The image forming apparatus according to the twenty-first aspect further comprises, in any one aspect of the first aspect to the twentieth aspect, an image readout apparatus that reads the print result of the user image printed by using the print head; and a signal processing apparatus that processes a readout image acquired by using the image readout apparatus, in which the signal processing apparatus performs processing as the streak detection unit and the nozzle state estimation unit.

A printed matter manufacturing method according to the twenty-second aspect is a method for manufacturing a printed matter on which a user image is formed, the method comprising printing the user image including the partial region subjected to the first correction by using the image forming apparatus according to any one aspect of the first aspect to the twenty-first aspect.

An image forming method according to the twenty-third aspect is a method for forming an image by using a print head that has a plurality of nozzles for ejecting a liquid droplet, the method comprising: a step of associating the nozzle with a partial region in a user image designated as an image of a target whose image is formed; a step of performing a first correction assuming that the associated nozzle is abnormal in at least one of the partial regions; a step of causing the print head to print the user image including the partial region subjected to the first correction; a step of detecting streak information from a print result of the user image including the partial region subjected to the first correction; and a step of estimating a state of the nozzle on the basis of the streak information of two or more partial regions in a single user image printed by using the print head.

In the twenty-third aspect, the same matters as specific matters of the image forming apparatus specified in the second aspect to the twenty-first aspect can be appropriately combined. In that case, elements of a processing unit and a function unit as units for the processing and operations specified in the image forming apparatus can be grasped as elements of steps (processes) of the corresponding processing and operations. In addition, the image forming method of the twenty-third aspect can be understood as a method of manufacturing an image formed matter and a method of manufacturing a printed matter.

An abnormal nozzle detection method according to the twenty-fourth aspect is a method for detecting an abnormal nozzle of a print head that has a plurality of nozzles for ejecting a liquid droplet, the method comprising: a step of associating the nozzle with a partial region in a user image designated as an image of a target whose image is formed; a step of performing a first correction assuming that the associated nozzle is abnormal in at least one of the partial regions; a step of causing the print head to print the user image including the partial region subjected to the first correction; a step of detecting streak information from a print result of the user image including the partial region subjected to the first correction; and a step of estimating a state of the nozzle on the basis of the streak information of two or more partial regions in a single user image printed by using the print head.

In the twenty-fourth aspect, the same matters as the specific matters of the image forming apparatus specified in the second aspect to the twenty-first aspect can be appropriately combined. In that case, elements of a processing unit and a function unit as units for the processing and operations specified in the image forming apparatus can be grasped as elements of steps (processes) of the corresponding processing and operations.

According to the present invention, an abnormal nozzle can be efficiently specified from a single user image printed by using a print head. According to the present invention, it becomes possible to suppress the consumption of an extra medium. In addition, according to the present invention, it is possible to detect streaks and specify abnormal nozzles without increasing waste paper, and perform correction in response to the abnormal nozzles.

DESCRIPTION OF THE PREFERRED EMBODIMENTS

Figure 1:
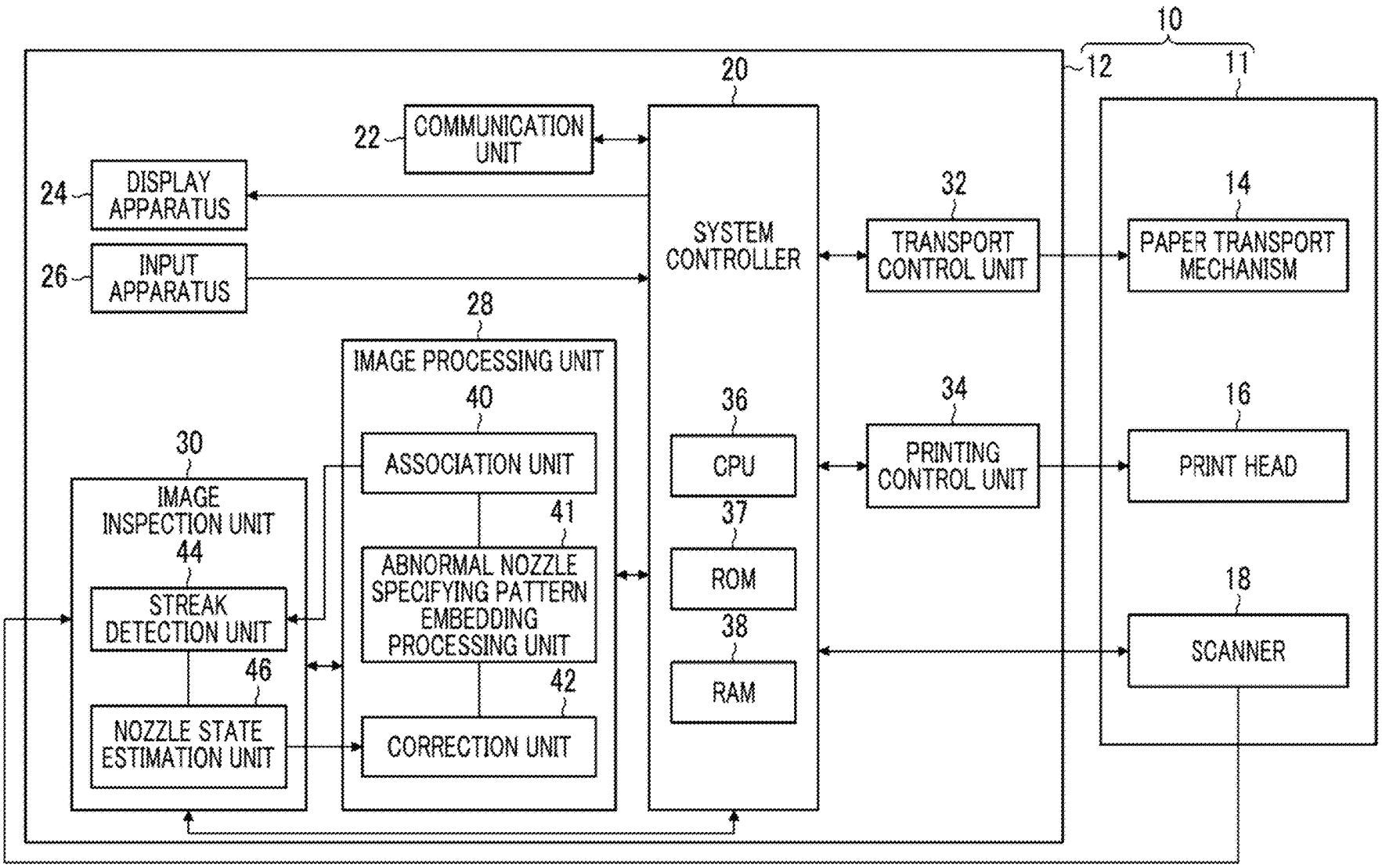
FIG. 1 is a block diagram schematically showing a configuration of an image forming apparatus according to an embodiment of the present invention.

Hereinafter, the embodiment of the present invention will be described in detail with reference to the accompanying drawings.

Outline of Embodiment

An image forming apparatus according to an embodiment of the present invention is a single-pass inkjet printing apparatus, and performs printing by embedding an abnormal nozzle specifying pattern which cannot be recognized by a user on a user image in order to suppress an increase of waste paper in a case where an abnormal nozzle occurs and/or to suppress an increase of a non-user image region.

The abnormal nozzle specifying pattern is an inspection pattern used for specifying the abnormal nozzle from a print result. The abnormal nozzle specifying pattern of the present embodiment is a correction pattern in which a streak defect due to a nozzle disabled for ejection is made invisible by virtually assuming a certain nozzle as an abnormal nozzle in the region of the user image and performing a streak correction by disabling the assumed abnormal nozzle for ejection.

Different nozzles are virtually set as abnormal nozzles in different regions on the user image, each virtual abnormal nozzle is corrected for each region, and a correction pattern made invisible for each region is formed.

In the present embodiment, by printing a user image in which such an abnormal nozzle specifying pattern made invisible is embedded, in a case where ejection of any nozzle actually becomes abnormal and streaks are generated in an image of a print result, an abnormal target nozzle (actual abnormal nozzle) can be specified from the print result and the streaks due to the specified abnormal nozzle can be corrected.

Explanation of Terms

The "user image" refers to an image designated by the user as an image of a target whose image is formed. That is, the "user image" refers to an image designated by the user as a print output target. The user image is synonymous with an "actual image" and a "print designation image".

The "abnormal nozzle" refers to a nozzle with an ejection abnormality. Some nozzles in the print head may not eject a liquid droplet even in a case where an ejection signal is given, or may eject a liquid droplet but a landing position or a volume of the liquid droplet is significantly deviated from a defined landing position or a defined volume. The nozzles with the ejection abnormality are called abnormal nozzles. "Abnormal" is synonymous with "defective".

The "streak correction" is a correction technique for making a streak-shaped image defect due to an abnormal nozzle invisible. The streak-shaped image defect is referred to as a "streak defect" or simply a "streak". The streaks include not only continuous streaks but also intermittent streaks. The streak correction referred to in the present embodiment indicates a correction technique for making the streaks invisible by disabling the abnormal nozzles for ejection and using surrounding nozzles to supplement recording.

The "ejection disability" refers to processing of forcibly setting a nozzle into an unavailable state. A nozzle disabled for ejection becomes a state where a liquid droplet cannot be ejected, and becomes the ejection disability. The ejection disability can be rephrased as a non-ejection, a non-use, or masking.

The "invisibility" refers to a state in which visibility is suppressed to such an extent that a defect cannot be perceived in observation by the naked eye and the defect can be treated as substantially free of the defect (streak). The correction to "make a streak invisible" indicates correction to lower the visibility of streaks such that the streaks generated by an abnormal ejection state of a nozzle are not noticeable. The "invisibility" is synonymous with "low visibility". In the present specification, the expression "streak correction" or "correct streaks" means to perform correction for making the streaks invisible. In addition, in the present specification, the expression "correction of abnormal nozzle" or "correct abnormal nozzle" means to perform correction for making streaks due to an abnormal nozzle invisible.

The "forming" of an image includes concepts of terms such as recording, press, copy, drawing, and print of the image. The "printing" includes concepts of dot-based recording and plateless printing based on digital data.

The term "image forming apparatus" includes concepts of terms such as a press machine, a printer, a copy apparatus, a press apparatus, an image recording apparatus, an image output apparatus, or a drawing apparatus. In addition, the term "apparatus" includes a concept of "system" configured by combining a plurality of apparatuses.

The "image" is to be interpreted in a broad sense, and includes a color image, a monochrome image, a single color image, a gradation image, a uniform density (solid) image, and the like. The "image" is used as a comprehensive term including not only a photographic image but also a design, a character, a symbol, a line drawing, a mosaic pattern, a pattern with different colors, other various patterns, or an appropriate combination thereof. In addition, the term "image" may indicate a digital image or image data.

The term "print head" is synonymous with terms such as a recording head, a press head, a copy head, a drawing head, and includes concepts of an inkjet head, an ink ejection head, a liquid ejection head, a liquid droplet ejecting head, or a liquid droplet discharging head. The "print head" may be simply notated as a "head".

Configuration Example of Image Forming Apparatus

FIG. 1 is a block diagram schematically showing a configuration of an image forming apparatus according to an embodiment of the present invention. The image forming apparatus 10 includes an inkjet printing apparatus main body 11 and a control apparatus 12. The inkjet printing apparatus main body 11 comprises a paper transport mechanism 14, a print head 16, and a scanner 18.

The paper transport mechanism 14 is a mechanism for transporting paper as a print medium, and includes an entire mechanism portion related to a paper transport from paper feeding to paper discharging. The paper transport mechanism 14 includes a motor as a power source (not shown) and a drive unit such as a motor drive circuit. The paper transport mechanism 14 corresponds to a relative movement mechanism that relatively moves paper with respect to the print head 16.

The print head 16 is a line head in which a large number of nozzles are arranged in a paper width direction orthogonal to a paper transport direction. In a case of an apparatus configuration using a plurality of colors of ink, the print head 16 is provided for each color of ink.

The scanner 18 is an image readout apparatus that reads an image printed by the print head 16. The scanner 18 is an apparatus that transforms an optical image into electronic image data by using an image pick-up device represented by a charge-coupled device (CCD) sensor or a complementary metal-oxide semiconductor device (CMOS) sensor. The image pick-up device may be a two-dimensional image sensor or a line sensor. In addition, a color image pick-up device may be adopted, a monochrome image pick-up device may be adopted, or a combination thereof may be adopted.

The scanner 18 may be an in-line scanner disposed in a paper transport path of the inkjet printing apparatus main body 11 or a flat bed type off-line scanner. In the present embodiment, the in-line scanner will be described as an apparatus used to image a printed matter and acquire an inspection image.

The control apparatus 12 comprises a system controller 20, a communication unit 22, a display apparatus 24, an input apparatus 26, an image processing unit 28, an image inspection unit 30, a transport control unit 32, and a printing control unit 34. Functions of each unit in the control apparatus 12 can be configured by a combination of hardware and software of one or a plurality of computers. Software is synonymous with "program."

The system controller 20 functions as a controller that comprehensively controls each unit of the image forming apparatus 10 and also functions as a calculation means that performs various calculation processing. The system controller 20 includes a central processing unit (CPU) 36, a read-only memory (ROM) 37, and a random access memory (RAM) 38, and operates according to a predetermined control program. The ROM 37 stores programs executed by the CPU 36 and various data required for control. The RAM 38 stores data used for the processing of the system controller 20. In addition, the RAM 38 is used as a storage region for storing data used for the processing of the image processing unit 28 and the image inspection unit 30 and data of calculation results.

The communication unit 22 comprises a required communication interface. The image forming apparatus 10 is connected to a host computer (not shown) via the communication unit 22 and can send and receive data to and from the host computer. The term "connection" used herein includes a wired connection, a wireless connection, or a combination thereof. The communication unit 22 may be equipped with a buffer memory for increasing a communication speed. The communication unit 22 serves as an image input interface unit for acquiring image data representing a print target image designated by the user.

A user interface is configured by the display apparatus 24 and the input apparatus 26. The display apparatus 24 may be, for example, a liquid crystal display, an organic EL (organic electro-luminescence: OEL) display, a projector, or an appropriate combination thereof. The input apparatus 26 may be an operation button, a keyboard, a mouse, a touch panel, a voice input apparatus, or an appropriate combination thereof.

An operator can input various kinds of information such as the input of printing conditions, selection of an image quality mode, input of other setting matters, input and edit of attached information, and search of information by using the input apparatus 26 while viewing contents displayed on a screen of the display apparatus 24. In addition, the operator can confirm the input contents and other various kinds of information through the display on the display apparatus 24. The display apparatus 24 functions as an error information notification unit that notifies error information. For example, in a case where streaks are detected in the printed matter, the streak detection information is displayed on the screen of the display apparatus 24.

The image processing unit 28 performs processing of generating dot image data for print control based on the input user image data. The image processing unit 28 includes an association unit 40, an abnormal nozzle specifying pattern embedding processing unit 41, and a correction unit 42.

The association unit 40 performs processing of associating the nozzle and the partial region with respect to the partial region in the user image. In the case of this example, the association unit 40 divides a region of the user image into a plurality of partial regions, and associates nozzles with each of the divided partial regions. The association unit 40 defines a correspondence relationship between a position of each partial region on the user image and a position of the nozzle. Information indicating the position of the partial region on the user image is referred to as "region position information". The position of the nozzle is represented by, for example, a nozzle number.

The abnormal nozzle specifying pattern embedding processing unit 41 performs signal processing for embedding the abnormal nozzle specifying pattern in the user image. The abnormal nozzle specifying pattern embedding processing unit 41 is an example of the "first correction unit". In the case of embedding the abnormal nozzle specifying pattern in the user image, the abnormal nozzle specifying pattern embedding processing unit 41 selects a combination of nozzles that are virtually assumed to be abnormal such that streaks are not generated due to the embedding. For example, the abnormal nozzle specifying pattern embedding processing unit 41 refers to region correction information for an existing abnormal nozzle which has already been specified to be abnormal, and selects a combination of nozzles according to a rule of "do not make the correction nozzle continuous". The abnormal nozzle specifying pattern embedding processing unit 41 performs processing of embedding the abnormal nozzle specifying pattern in at least one partial region of the user image region, preferably in a plurality of partial regions.

The image processing unit 28 performs various transformation processing, correction processing, and halftone processing on image data to be printed. The transformation processing includes pixel number conversion, gradation transformation, color transformation, and the like. The correction processing includes density correction and streak correction. The correction unit 42 performs streak correction processing that makes streaks due to the abnormal nozzles specified by the image inspection unit 30 invisible. The streak correction performed by the correction unit 42 is an example of the "second correction". The correction unit 42 is an example of the "second correction unit".

The image inspection unit 30 includes a streak detection unit 44 and a nozzle state estimation unit 46. The streak detection unit 44 analyzes a readout image obtained from the scanner 18 and performs processing of detecting a defective portion in the image, particularly streaks. The streak detection unit 44 detects streak information for each of the partial regions specified by the association unit 40.

The nozzle state estimation unit 46 estimates a state of the nozzle by using the streak information for each partial region obtained by the streak detection unit 44, and specifies an abnormal nozzle. Information on the abnormal nozzle specified by the nozzle state estimation unit 46 is sent to the correction unit 42. The correction unit 42 performs correction to form a correction pattern in the entire region of a pixel row for which the specified abnormal nozzle is in charge of printing. The correction performed by the correction unit 42 is also referred to as "nozzle correction" because it corrects the entire region of the abnormal nozzle, which is in charge of printing.

Further, the information on the specified abnormal nozzle is stored in the RAM 38 and/or a storage apparatus such as a storage device (not shown) as abnormal nozzle information disabled for ejection by the correction unit 42. The storage apparatus such as the RAM 38 is an example of the "information storage unit". An information file that describes the abnormal nozzle information is referred to as an abnormal nozzle mask file. The abnormal nozzle mask file is updated each time the abnormal nozzle is specified by the nozzle state estimation unit 46.

Instead of the abnormal nozzle mask file, or in addition to the abnormal nozzle mask file, the correction information (referred to as "region correction information") of the region in which the nozzle correction is performed by the correction unit 42 may be used.

A processing function of the image inspection unit 30 may be included in the image processing unit 28. Each of the image processing unit 28 and the image inspection unit 30 may be configured to be included as a functional block in the control apparatus 12 including the system controller 20, or may be configured by a computer different from the control apparatus 12 including the system controller 20. In addition, a portion or all of the control apparatus 12, such as the processing functions of the image processing unit 28 and the image inspection unit 30, may be realized by an integrated circuit. The control apparatus 12 having the processing function of the image inspection unit 30 is an example of a "signal processing apparatus that processes the readout image".

The transport control unit 32 controls the paper transport mechanism 14 according to a command from the system controller 20.

The printing control unit 34 controls a drive of the print head 16 according to the command from the system controller 20. The printing control unit 34 controls the ink ejection operation of the print head 16 on the basis of the dot image data generated through the halftone processing of the image processing unit 28.

Outline of Image Forming Method

Figure 2:
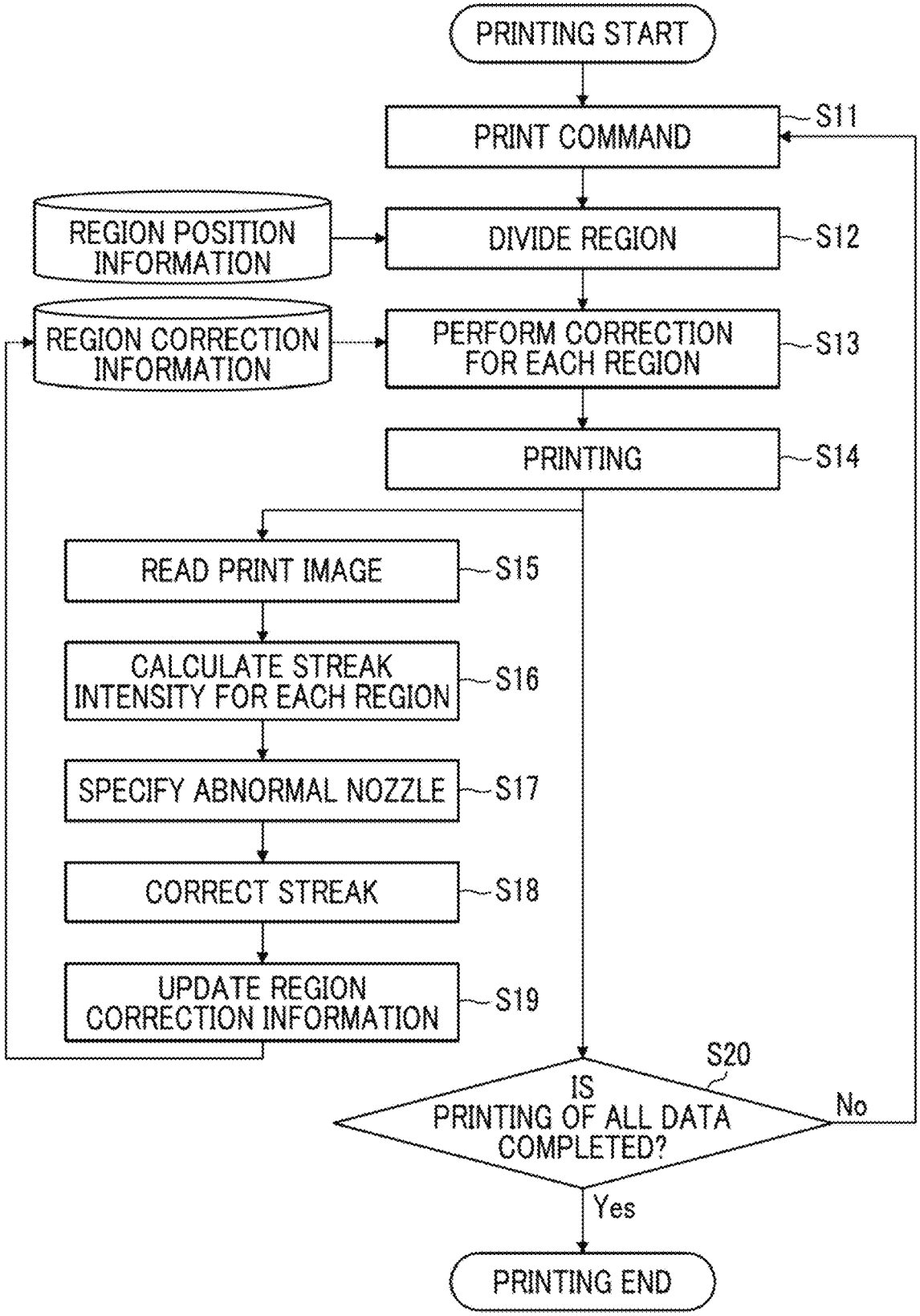
FIG. 2 is a flowchart showing an example of a flow of printing operation in the image forming apparatus according to the embodiment of the present invention.

FIG. 2 is a flowchart showing an example of a flow of printing operation in the image forming apparatus according to the embodiment of the present invention. Each step of the flowchart shown in FIG. 2 is executed by the image forming apparatus 10 including the control apparatus 12.

In step S11, the control apparatus 12 receives a print command. The print command may be given from an external apparatus such as a host computer (not shown) or may be given via the input apparatus 26. The print command includes data of the user image designated as an image of a target whose image is formed.

In the next step S12, the control apparatus 12 divides a single user image region into a plurality of partial regions on the basis of the print command. Region division processing in step S12 is performed by the association unit 40 described with reference to the region position information in FIG. 1. Step S12 is an example of "a step of associating the partial region in the user image with the nozzle".

In the next step S13, the control apparatus 12 performs correction on the assumption that different nozzles are virtually abnormal for each of the divided partial regions. The correction processing of step S13 is performed by the abnormal nozzle specifying pattern embedding processing unit 41 described in FIG. 1. The abnormal nozzle specifying pattern embedding processing unit 41 refers to the region correction information, selects a combination of nozzles that are virtually abnormal, and embeds the correction pattern. Step S13 is an example of a "step of performing the first correction".

In step S14, the image forming apparatus 10 executes printing of the user image in which the abnormal nozzle specifying pattern is embedded. The control apparatus 12 controls the ink ejection operation of the print head 16 via the printing control unit 34 on the basis of the dot image data for printing generated by the image processing unit 28. Step S14 is an example of a "step of printing the user image on the print head".

Next, in step S15, the image forming apparatus 10 reads the print image, which is the print result, with the scanner 18, and acquires the readout image. The readout image is synonymous with a scan image.

In the next step S16, the image forming apparatus 10 calculates the streak intensity for each partial region from the obtained readout image. The streak intensity calculation processing in step S16 is performed by the streak detection unit 44 of the image inspection unit 30 described in FIG. 1. The streak intensity expresses a degree of visibility of the streak as "strength". Streaks that are clearly visible have high streak intensity, and streaks that are difficult to see have weak streak intensity. The streak intensity can be quantitatively evaluated on the basis of a signal value of a pixel of the readout image obtained by reading the print image. The signal value of the pixel is referred to as a "pixel value" or an "image signal value". As a method of evaluating the streak intensity, for example, a streak intensity signal that quantitatively indicates the streak intensity can be used as disclosed in JP2017-181094A. The streak intensity is an example of streak information. Step S16 is an example of "a step of detecting the streak information".

In the next step S17, the image forming apparatus 10 estimates the state of the nozzle, or the state of the nozzle and the state of correction, from the information on the streak intensity calculated for each partial region, and specifies the abnormal nozzle. The abnormal nozzle specifying processing of step S17 is performed by the nozzle state estimation unit 46 described in FIG. 1. Step S17 is an example of a "step of estimating the state of the nozzle".

In the next step S18, the image forming apparatus 10 corrects streaks due to the abnormal nozzle according to the nozzle state obtained in step S17. The correction processing of step S18 is performed by the correction unit 42 described in FIG. 1.

In the next step S19, the image forming apparatus 10 updates the region correction information by reflecting the correction information for the abnormal nozzle specified in step S17.

After step S19, the process returns to step S13. The updated region correction information is used in a case of selecting a nozzle assumed to be virtually abnormal such that streaks are not generated in correction of the virtual abnormal nozzle set for each partial region in the next step S13.

After printing in step S14, the control apparatus 12 determines in step S20 whether or not printing of all data is completed. In a case where it is determined in determination processing of step S20 that printing of all the data of the number of papers and the number of pages designated by a job is not completed, the control apparatus 12 returns to step S11 and repeats steps S11 to S20.

In a case where the printing of all the data is completed, the determination processing in step S20 is Yes, and this flowchart ends.

The image forming method shown in the flowchart of FIG. 2 can be understood as a printed matter manufacturing method. In addition, the image forming method shown in the flowchart of FIG. 2 can be understood as an abnormal nozzle detection method of specifying an abnormal nozzle by using the user image region.

Explanation of Abnormal Nozzle Specifying Pattern

Here, the abnormal nozzle specifying pattern proposed in the present disclosure will be described in comparison with a conventional nozzle check pattern. To simplify the description, an example of printing a gray gradation pattern by using an inkjet head in which 100 nozzles are aligned in a paper width direction will be described.

Figure 3:
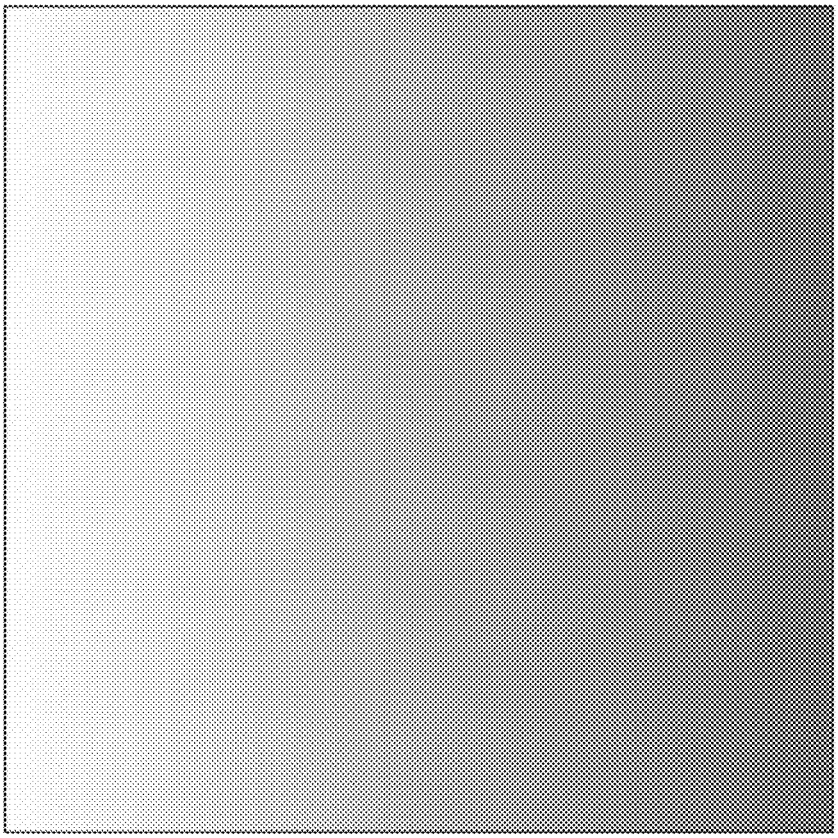
FIG. 3 is an example of an input image in a case where a gray gradation pattern is printed as a user image.

FIG. 3 is an example of an input image in a case where a gray gradation pattern is printed as a user image. A horizontal direction of FIG. 3 is the paper width direction, and a vertical direction of FIG. 3 is a paper transport direction. In FIG. 3, an image range of 100×100 pixels is shown. For the convenience of illustration, an outer edge of the user image region is indicated by a solid line in order to clearly display the image range of the user image. The same applies to FIGS. 4 to 9 and FIGS. 11 to 22.

Figure 4:
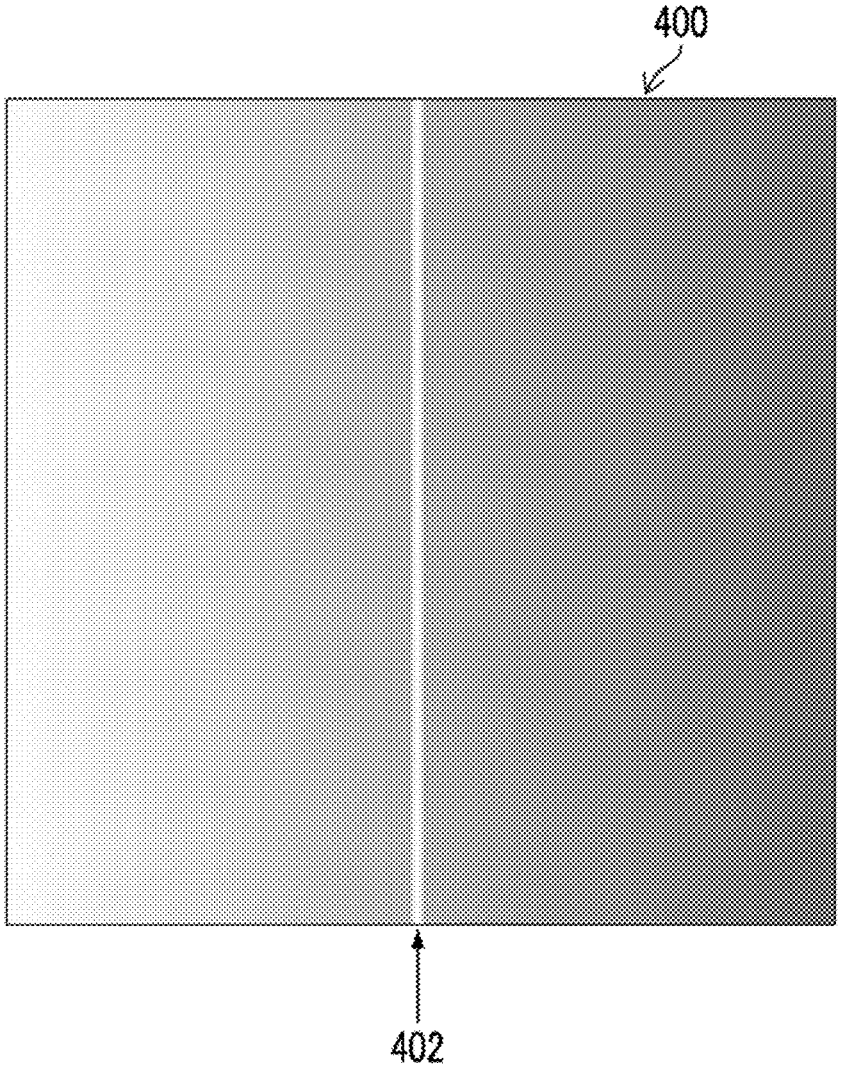
FIG. 4 is a view showing an image example of a print result for the input image of FIG. 3.

FIG. 4 is a view showing an image example of a print result for the input image of FIG. 3. FIG. 4 is an image showing an "appearance" of the print result in a case where an ejection of the fiftieth nozzle in the center of the alignment of 100 nozzles becomes abnormal and the ejection disability occurs. FIG. 4 may be understood as a print image appearing on an output which is a printed result, or as a readout image obtained by reading an output with the scanner 18, that is, a scan image.

In the print image 400 shown in FIG. 4, there is a streak 402 along the paper transport direction due to the ejection disability of nozzles. According to the related art, it is difficult to determine which nozzle becomes abnormal and the streak 402 is generated only from the print image 400.

Comparative Example

Figure 5:
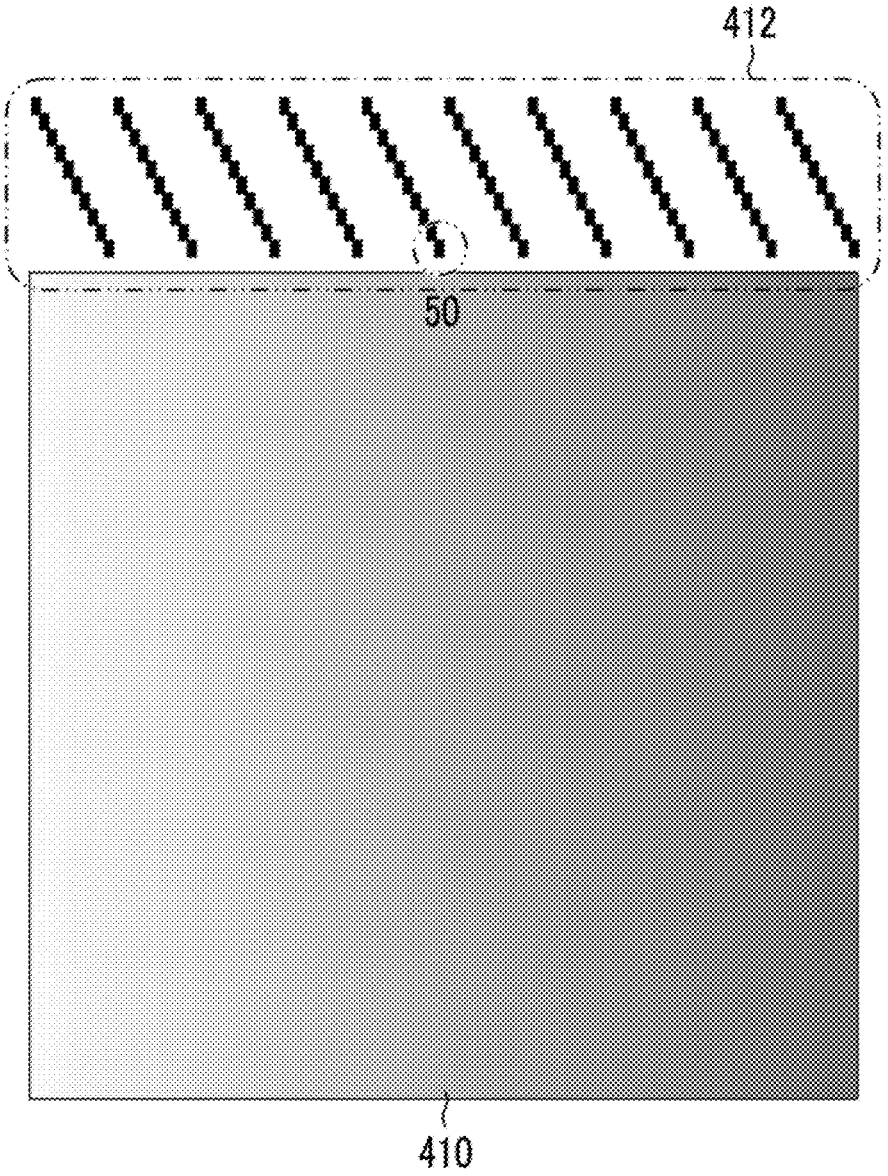
FIG. 5 is a view showing an image example of a comparative example in which a nozzle check pattern is added to the input image.

Therefore, in the related art, for example, as shown in FIG. 5, a nozzle check pattern 412 is added to the input image 410. The nozzle check pattern 412 is a line pattern for inspecting an ejection state of each nozzle. As the nozzle check pattern 412, for example, a 1-on-N-off type ladder pattern is known. FIG. 5 shows an example in which a 1-on-9-off type nozzle check pattern 412 is added outside a region of the input image 410 as the user image. In addition, the display of "50" in FIG. 5 is a nozzle number representing a position of the nozzle, and represents a position in which the fiftieth nozzle is in charge of printing.

Figure 6:
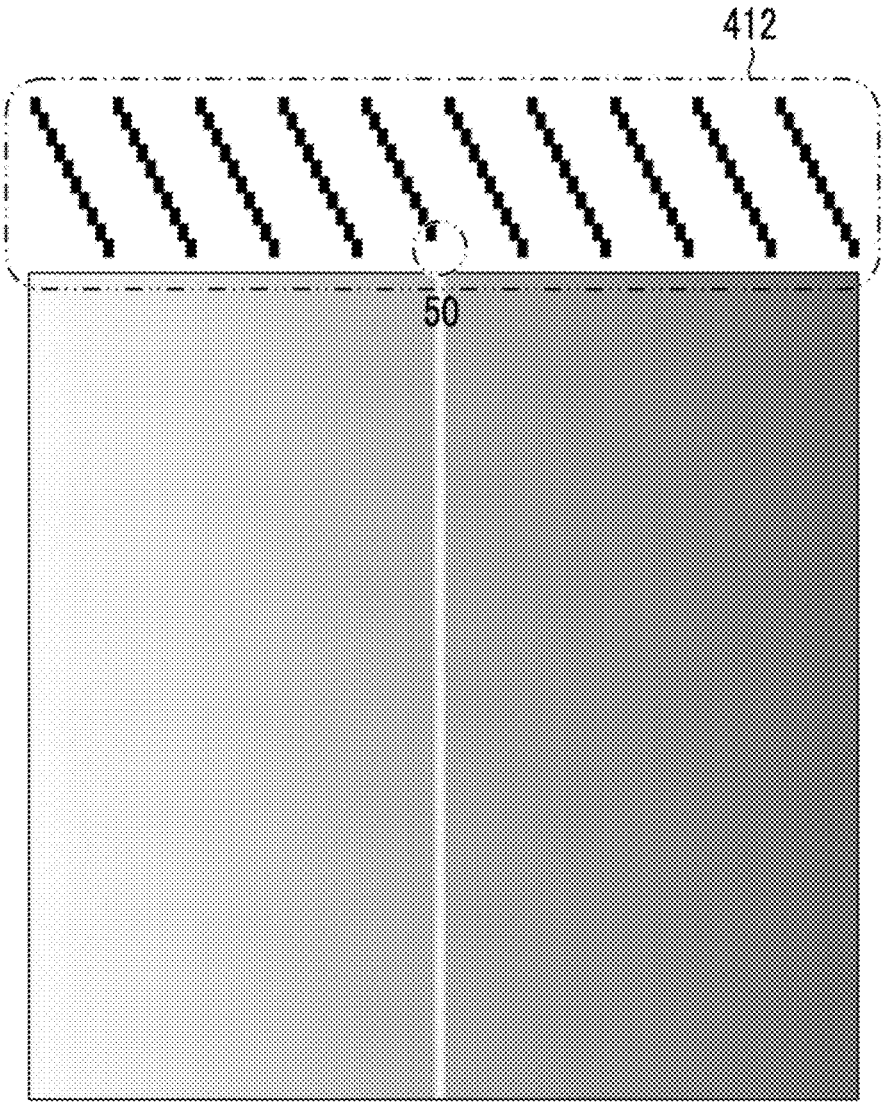
FIG. 6 is a view showing an image example of a print result for the input image including the nozzle check pattern of FIG. 5.

FIG. 6 is a view showing an image example of a print result for the input image including the nozzle check pattern of FIG. 5. FIG. 6 is an image showing an "appearance" of the print result in a case where an ejection of the fiftieth nozzle in the center of the alignment of 100 nozzles becomes abnormal and the ejection disability occurs. FIG. 6 may be understood as to how the printed matter that is an output appear itself, or as a readout image obtained by reading an output with the scanner 18, that is, a scan image.

In the print result shown in FIG. 6, since the nozzle check pattern corresponding to the fiftieth nozzle has disappeared, it can be specified that the fiftieth nozzle is abnormal.

Hereinafter, in order to simplify the description, the nozzle number is used to represent the nozzle of the nozzle number. For example, the notation "nozzle number 50" means a "nozzle with nozzle number 50" and indicates the fiftieth nozzle.

Figure 7:
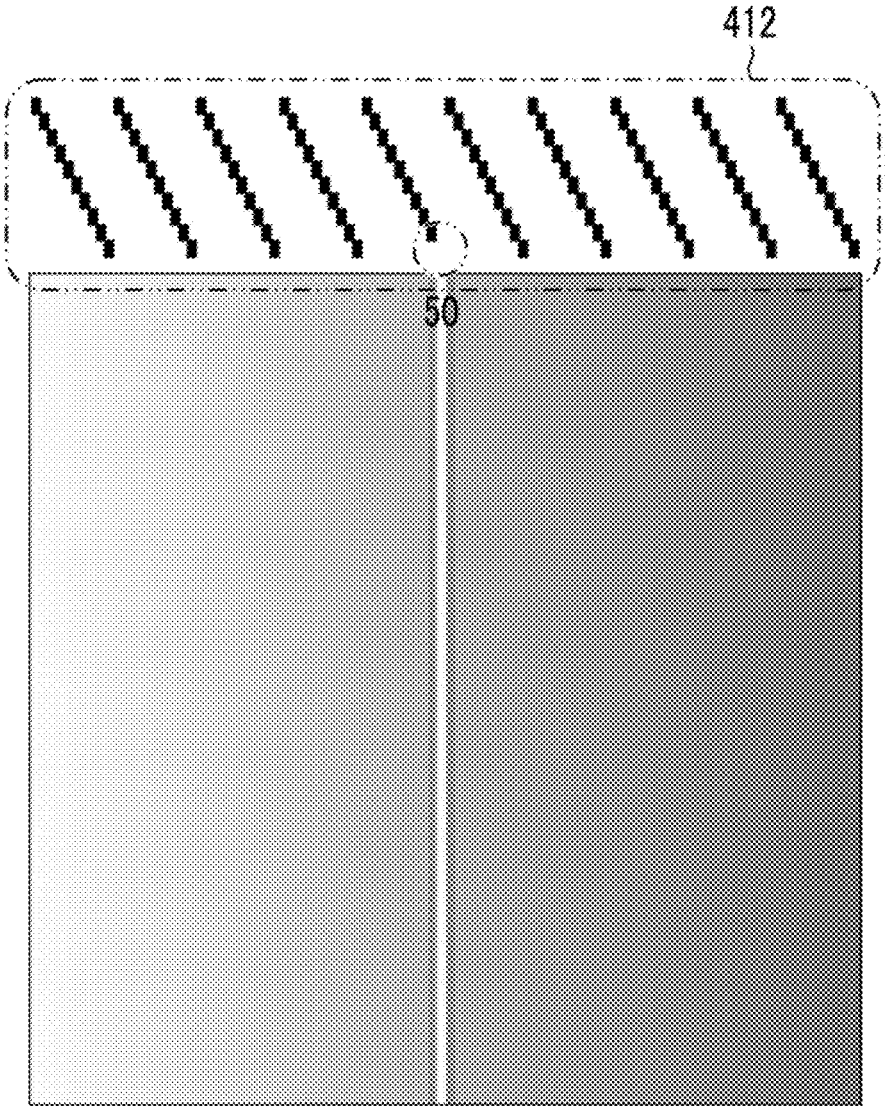
FIG. 7 is an example of an input image corrected in response to the abnormality of nozzle number 50.

FIG. 7 is an example of an input image corrected in response to the abnormality of nozzle number 50. In this example, the abnormal nozzle number 50 is disabled for ejection on the data of the input image, and the print density of each of the nozzle number 49 and the nozzle number 51 on both sides adjacent to the nozzle number 50 is increased, so that use of the abnormal nozzle (the nozzle number 50) is stopped and correction is performed by using another nozzle. Details of a specific correction method are disclosed in JP4018598B and JP2010-188663A, and the like.

Alternatively, the present invention is not limited to the correction method using the adjacent nozzle of the nozzle disabled for ejection, and in a case of an apparatus configuration comprising an alternative nozzle capable of printing the same position as the nozzle disabled for ejection, correction using the alternative nozzle is also possible. The alternative nozzle is sometimes called a redundant nozzle. The details of a correction method using the redundant nozzle and the nozzle distribution mask will be described later.

Figure 8:
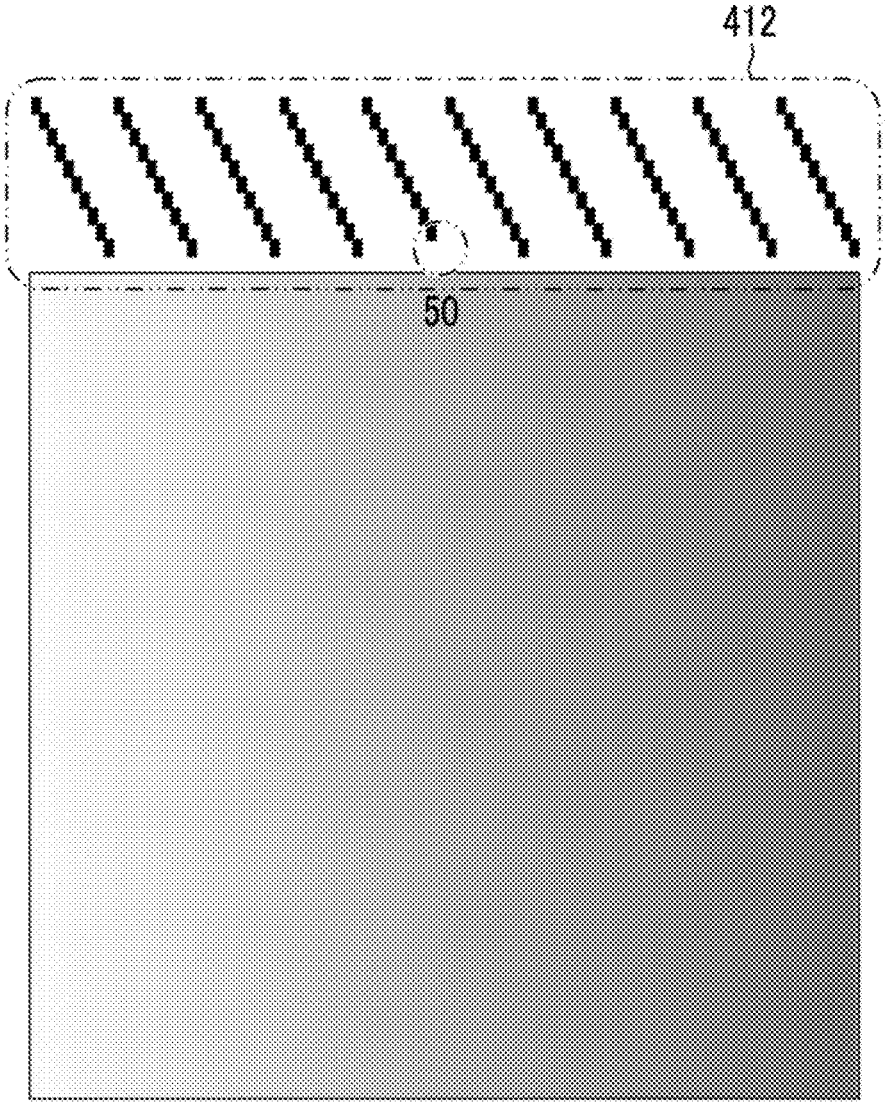
FIG. 8 is an example of a print image showing a print result after correction shown in FIG. 7.

FIG. 8 is an example of a print image showing a print result after correction described in FIG. 7. In FIG. 8, although the nozzle number 50 is disabled for ejection, since it is corrected by using the nozzle number 49 and the nozzle number 51 on both sides adjacent to the nozzle number 50, the streaks due to the ejection disability of the nozzle number 50 are appropriately made invisible.

However, as shown in FIG. 8, it is a problem that an extra nozzle check pattern 412 is added and printed outside the region of the user image.

<Explanation of Abnormal Nozzle Specifying Pattern in Present Embodiment>

Figure 9:
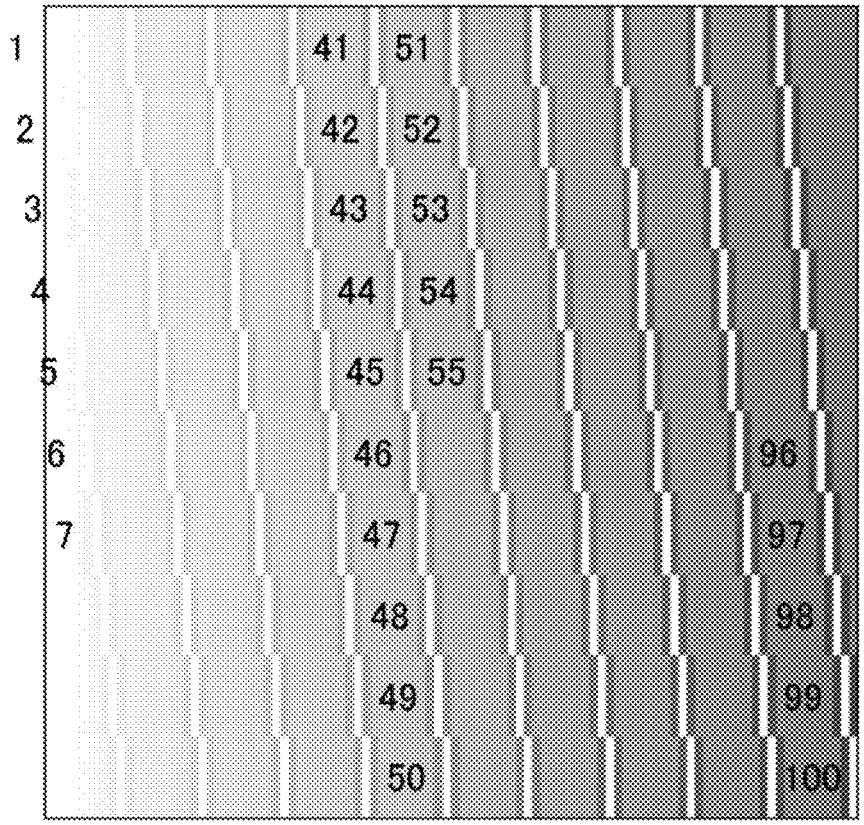
FIG. 9 is a view showing an example of an abnormal nozzle specifying pattern according to the present embodiment.

In the present embodiment, the nozzle abnormality is specified by embedding a plurality of patterns for inspecting the ejection state of the nozzle in a single user image. FIG. 9 shows an example of the abnormal nozzle specifying pattern.

Example 1 of Abnormal Nozzle Specifying Pattern

FIG. 9 is an input image in a case where the user image has the gray gradation pattern (refer to FIG. 3). The numbers displayed in FIG. 9 are nozzle numbers, and represent the nozzle numbers which are virtually abnormal and disabled for ejection. These numbers are not the information included in the input image.

On the user image, each nozzle from nozzle number 1 to nozzle number 100 is sequentially divided into a plurality of partial regions for inspection from the upper left in FIG. 9, and a streak correction in which corresponding nozzles are assumed to be virtually abnormal is applied in each partial region.

Figure 10:
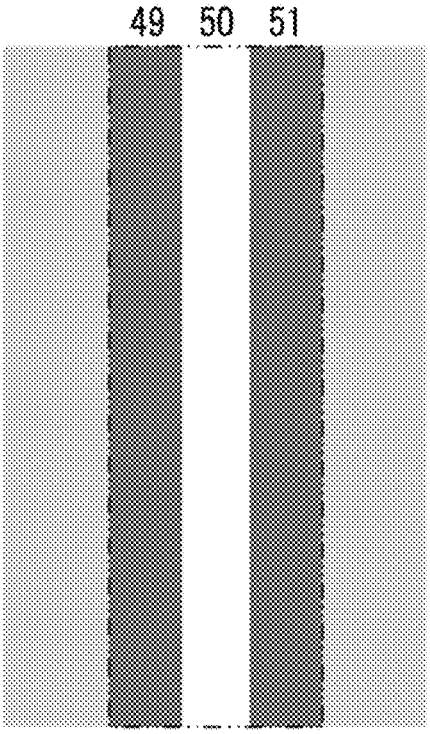
FIG. 10 is a partially enlarged view of FIG. 9.

For reference, FIG. 10 shows an enlarged view of the abnormal nozzle specifying pattern embedded in the partial region associated with the nozzle number 50. The range of the partial region can be defined, for example, as a rectangular range including pixels corresponding to a nozzle range including a virtual abnormal nozzle which is virtually abnormal and correction nozzles adjacent to both right and left sides of the virtual abnormal nozzle. In this example, two nozzles on both sides adjacent to the nozzle disabled for ejection are used as the correction nozzles, but the range of the correction nozzles is not limited to this example. For example, in addition to the nozzles on both sides adjacent to the nozzle disabled for ejection, nozzles adjacent to the nozzles may be included in the correction nozzles. That is, in a case where the nozzle number i is disabled for ejection, an aspect in which four nozzle numbers i−2, i−1, i+1, i+2 are used as the correction nozzles is also possible. Of course, the range of the correction nozzles may be further widened and six nozzles near the nozzle disabled for ejection may be used as the correction nozzles.

In this example, a length of the partial region in the paper transport direction is set to 10 pixels, but the length is not limited to this example and can be set to an appropriate length.

Figure 11:
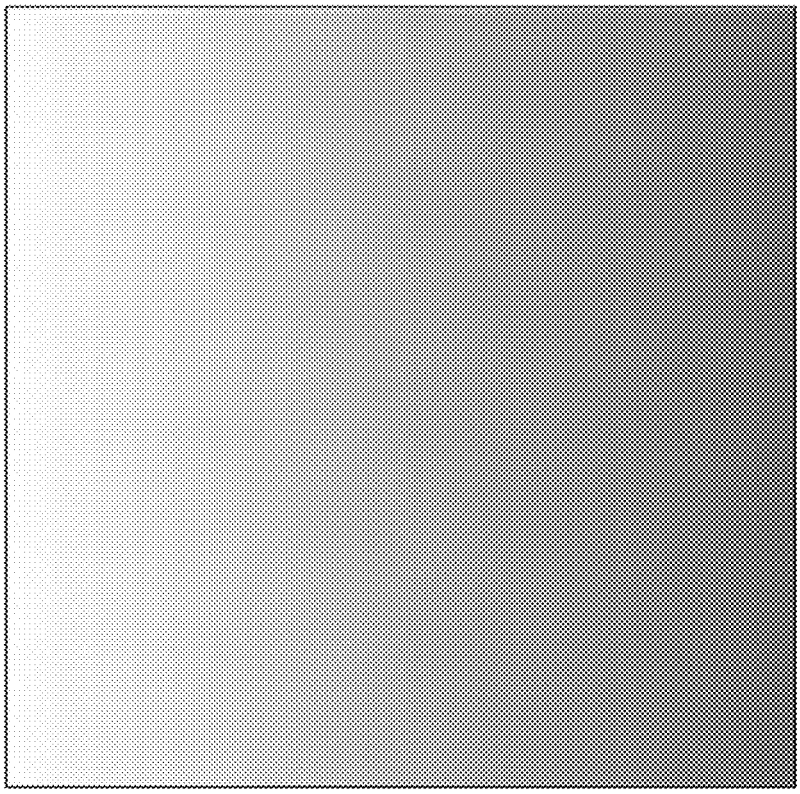
FIG. 11 is an example of an image showing an appearance of a print result obtained in a case where the image of FIG. 9 is printed.

FIG. 11 is an "appearance" of a print result obtained in a case where the image of FIG. 9 is printed. Since the pattern of each partial region is a correction pattern in which streaks are made invisible and used in the streak correction, in a case where the nozzles are not actually abnormal, it is considered that the user does not notice that the abnormal nozzle specifying pattern is embedded from the appearance of the printed image.

The abnormal nozzle specifying pattern as illustrated in FIG. 9 can be embedded in an almost random image.

Example 2 of Abnormal Nozzle Specifying Pattern

Figure 12:
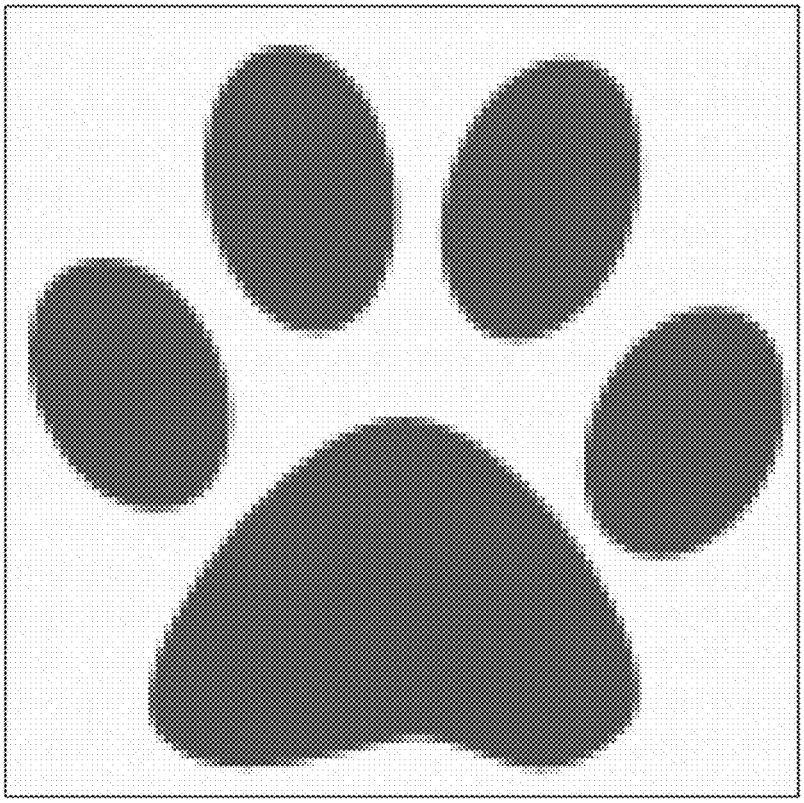
FIG. 12 is an image example of a user image in which a white background and a solid image are mixed.
Figure 13:
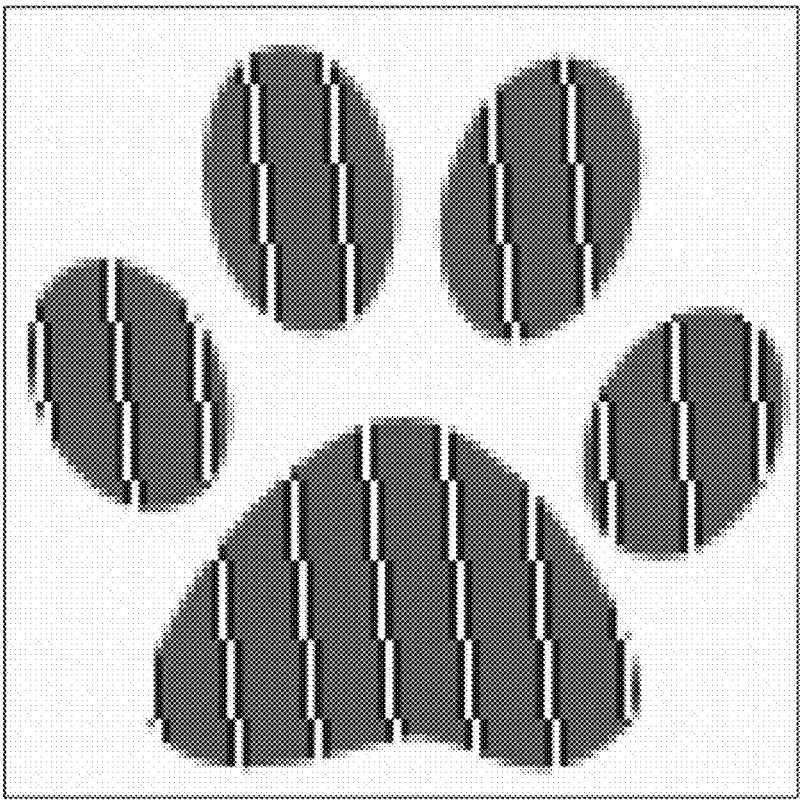
FIG. 13 is a view showing an example of an input image in a case where the abnormal nozzle specifying pattern is embedded in the user image shown in FIG. 12.

FIG. 12 is an image example of a user image in which a white background and a solid image are mixed. FIG. 13 is a view showing an example of an input image in a case where the abnormal nozzle specifying pattern is embedded in the user image shown in FIG. 12.

One of merits of using the abnormal nozzle specifying pattern of this example is that an inspection of the abnormal nozzle is automatically omitted in a white background portion in which streaks are not originally generated.

However, in a case where an inspection region is disposed on the white background portion even though a nozzle to be inspected is used in a solid portion, there may occur a case where an abnormality cannot be specified. In order to eliminate such a problem, it is possible to be configured to change disposition of a nozzle inspection region.

Example 3 of Abnormal Nozzle Specifying Pattern

Figure 14:
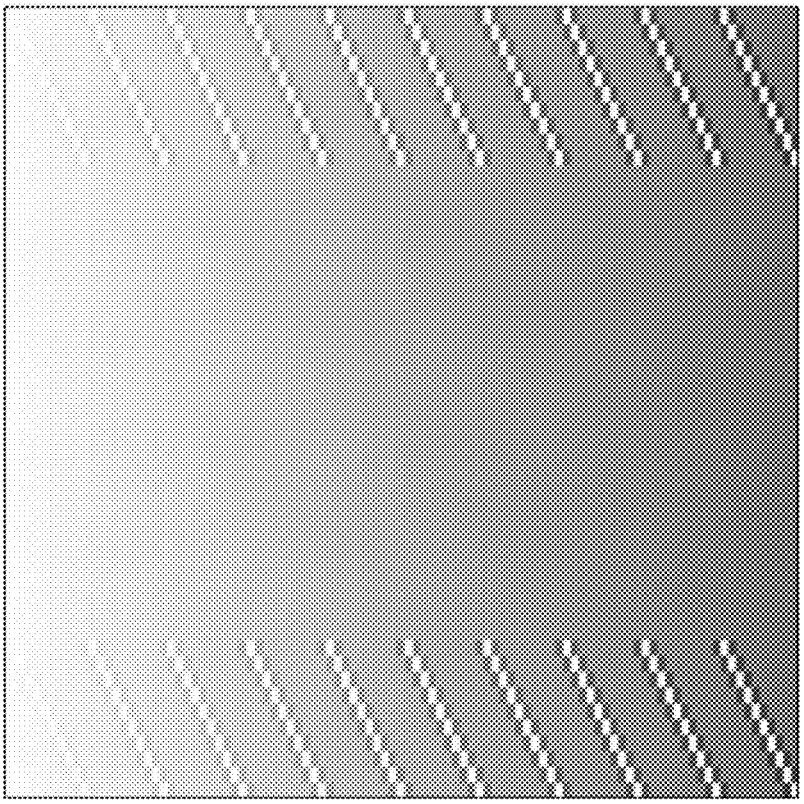
FIG. 14 is a view showing another example of the abnormal nozzle specifying pattern.

FIG. 14 shows another example of the abnormal nozzle specifying pattern. The abnormal nozzle specifying pattern may be configured to be embedded in a plurality of portions in the user image region as shown in FIG. 14. Thereby, an abnormal nozzle specifying accuracy can be improved. In addition, since it is possible to specify the abnormal nozzle in more places, it is possible to correspond to, for example, a specific omission depending on the user image and/or a case where the nozzle state changes in the page. As an example of a case where the specific omission depending on the user image occurs, there may be a case where the abnormal nozzle specifying pattern is disposed in a non-printing region of the user image region. Changing the nozzle state in a page indicates that the nozzle state changes during printing in a single image.

Example 4 of Abnormal Nozzle Specifying Pattern

Figure 15:
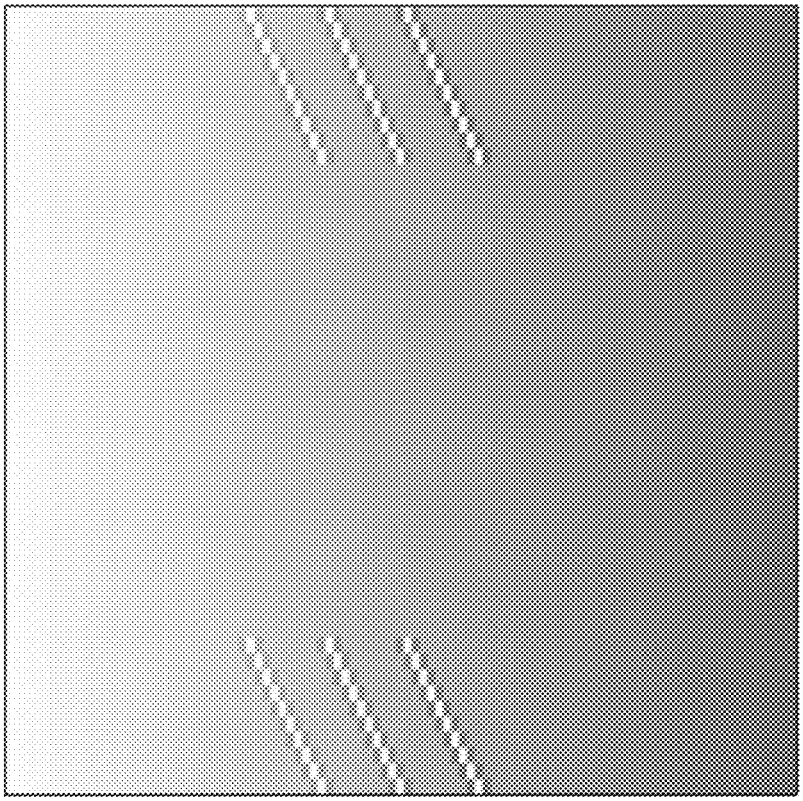
FIG. 15 is a view showing another example of the abnormal nozzle specifying pattern.

FIG. 15 shows another example of the abnormal nozzle specifying pattern. As shown in FIG. 15, it is possible to be configured to limit the inspection region in which the abnormal nozzle specifying pattern is embedded in the user image region. The inspection region may be designated by the user or may be mechanically set according to a program. For example, the disposition of the abnormal nozzle specifying pattern may be determined according to contents of the user image. In addition, the abnormal nozzle specifying pattern may be disposed in a region in which the streak has occurred immediately before and/or in a region in which the streak occurs frequently.

Since the abnormal nozzle specifying pattern tends to have streaks as compared with an uncorrected pattern, the inspection region in which the abnormal nozzle specifying pattern is embedded is limited in this way, so that unintended streaks can be suppressed from entering an embedded region portion of the abnormal nozzle specifying pattern.

Example 5 of Abnormal Nozzle Specifying Pattern

Figure 16:
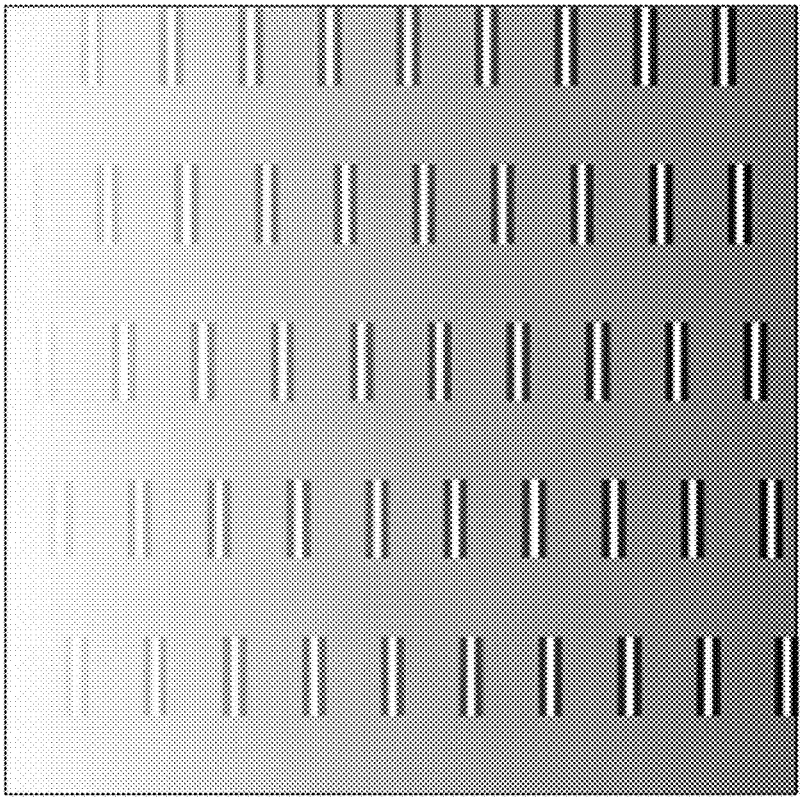
FIG. 16 is a view showing another example of the abnormal nozzle specifying pattern.

FIG. 16 shows another example of the abnormal nozzle specifying pattern. As shown in FIG. 16, it is possible to be configured to thin out the abnormal nozzle specifying pattern. FIG. 16 shows a configuration to thin out the abnormal nozzle specifying pattern for nozzles having even nozzle numbers. In FIG. 16, the abnormal nozzle specifying pattern in which a virtual abnormality is set is embedded only for nozzles having odd nozzle numbers without setting a virtual abnormality for nozzles having the even nozzle numbers.

Even in a case where the abnormal nozzle specifying pattern is thinned out in this way, the nozzle position can be determined stochastically from the results of a plurality of regions, so that it is not always necessary to set the inspection regions corresponding to all the nozzles.

In general, the correction for the abnormal nozzle has a different correction success probability depending on the characteristics of the print head, relative printing orders of the dots, and the like. For example, the correction success probability is higher in a case where the dots of the correction nozzle are printed first.

Therefore, in a case of embedding the abnormal nozzle specifying pattern in the user image, it is desirable to create the abnormal nozzle specifying pattern by using correction having a high correction success probability, and to determine the abnormality stochastically from the other pattern for a nozzle having a low correction success probability.

[About Application to Plurality of Colors]

For simplification, a case of a single color has been discussed as an example, but the present technology can also be applied to an inkjet printing apparatus capable of printing a plurality of colors. As in the case of the single color, it is desirable to inspect different color nozzles printed in the same region in different partial regions.

Streak Detection Method

As a technique for detecting streaks from the printed user image, a known technique disclosed in JP2016-193504A, JP2017-181094A or the like can be adopted.

In order to detect streaks from the user image, it is possible to detect the streaks by, for example, comparing changes in density with a previously output image without streaks (reference image) or comparing density with an original image.

Processing to Specify Abnormal Nozzle

Next, a method of specifying an abnormal nozzle that is a factor of streaks in a case where the streaks are generated will be described. As an example, a case will be described in which the nozzle number 50 becomes abnormal in a case of printing the user image of the monochromatic gradation shown in FIG. 3.

Figure 17:
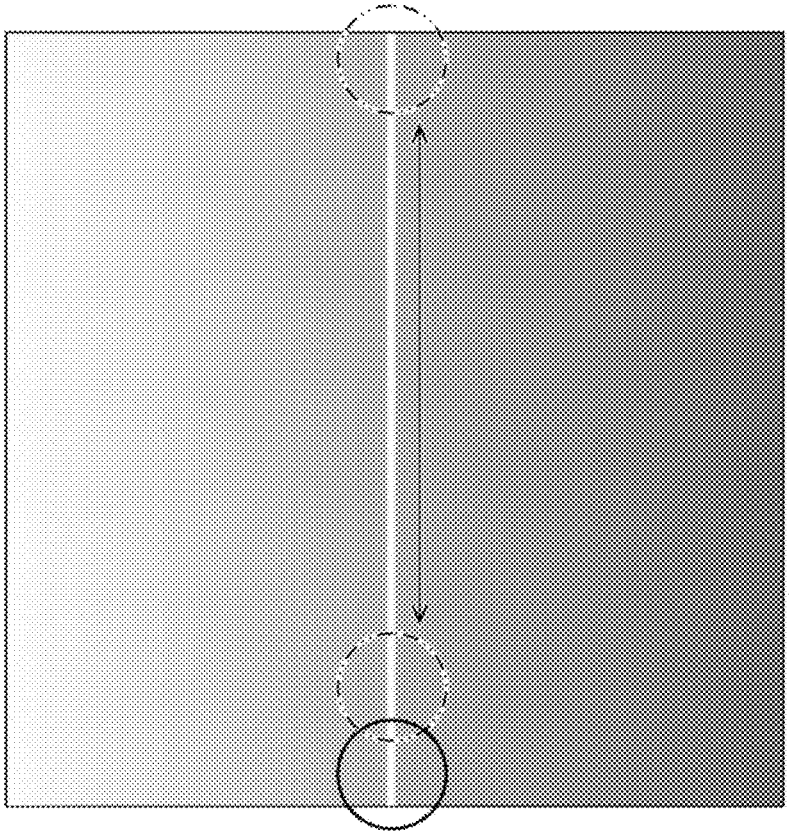
FIG. 17 is an image example showing how streaks appear in a case where the abnormal nozzle specifying pattern is not embedded.

FIG. 17 shows how streaks appear in a case where the abnormal nozzle specifying pattern is not embedded. In this case, since there is no non-uniformity in the pattern of dots disposed on the image, streaks are generated monotonously and uniformly along the paper transport direction.

On the other hand, in the embodiment of the present invention, since the abnormal nozzle specifying pattern using the correction pattern used for streak correction is embedded in the user image, the way of generating streaks in a case where the nozzle number 50 becomes abnormal is different from that in FIG. 17.

Figure 18:
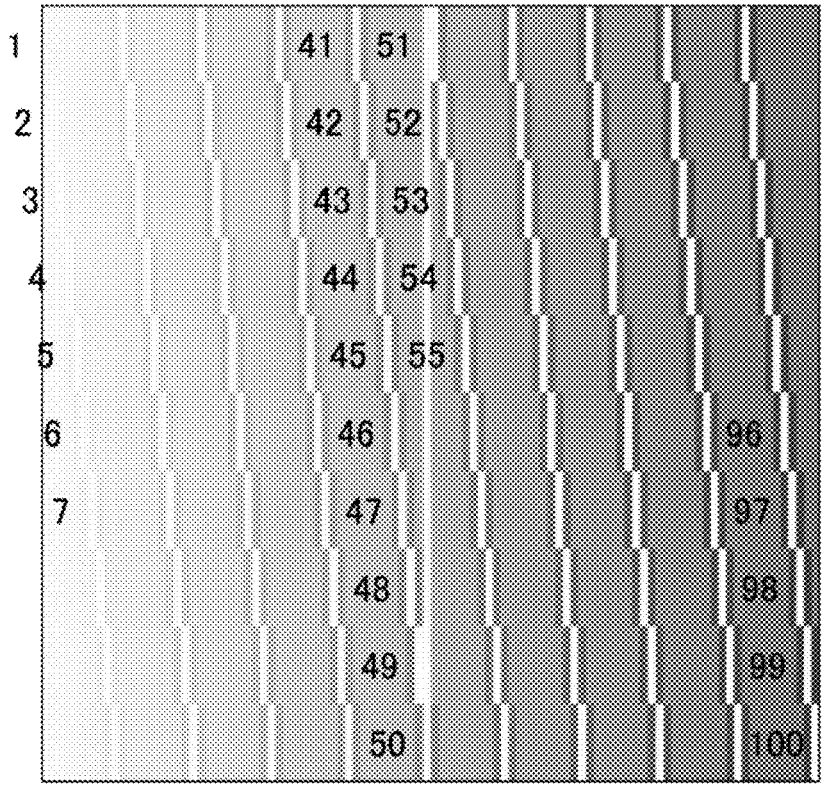
FIG. 18 is an image example in which a pixel of a nozzle number 50 disabled for ejection with respect to the input image is displayed in white.
Figure 19:
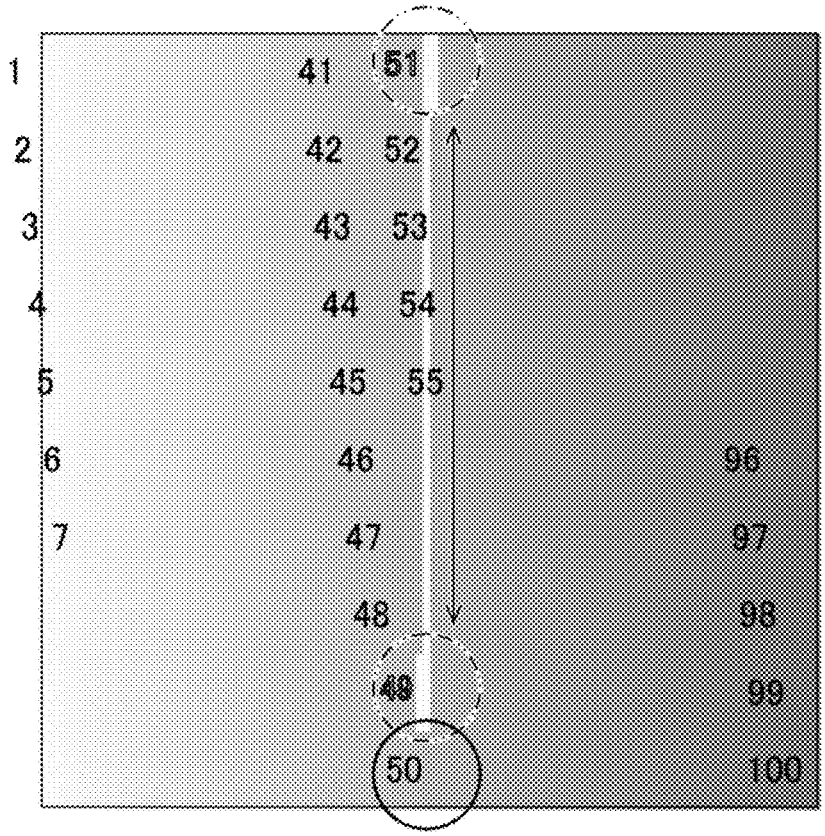
FIG. 19 is an image example showing how streaks appear in a case where the input image shown in FIG. 18 is actually printed out.

FIG. 18 is a diagram in which a pixel of a nozzle number 50 disabled for ejection with respect to the input image of this example is displayed in white. FIG. 19 is an image example showing how streaks appear in a case where the input image shown in FIG. 18 is actually printed out.

In a case where the print image shown in FIG. 19 is analyzed, the following characteristics of the streak are grasped.

[Characteristic a]

As shown in a portion surrounded by a circle of a solid line in FIG. 19, since the region (the portion of FIG. 18 displayed as "50") in which the nozzle number 50 is corrected is printed so as to correct the shortage of the nozzle number 50 by using another nozzle without using the nozzle number 50, streaks are not generated even in a case where an abnormality occurs in the nozzle number 50.

[Characteristic b]

Next, as shown in a portion surrounded by a circle of a two-dot chain line in FIG. 19, since in each partial region in which each of the nozzle number 49 and the nozzle number 51 is corrected, the shortage of the nozzle number 49 and the nozzle number 51 is corrected by using the nozzle number 50, the correction does not function due to the abnormality of the nozzle number 50 and very strong streaks are generated.

[Characteristic c]

Further, since the nozzle number 50 is abnormal in the remaining region (vicinity of pixels of nozzle numbers 45 to 48 and nozzle numbers 52 to 55), a certain amount of streaks is generated.

Therefore, it is possible to determine that the nozzle number 50 becomes abnormal by integrating the above-described information of the characteristics a to c. The nozzle state estimation unit 46 estimates a state of the nozzle from the viewpoints of the above-described characteristics a to c on the basis of streak information of the plurality of partial regions, and specifies the abnormal nozzle.

The information of all the characteristics a to c is not always necessary to specify the abnormal nozzle that causes the streak. The abnormal nozzle can be specified by using two pieces of information among these three pieces of information. For example, it is possible to specify the abnormal nozzle from the information of the characteristic a and the characteristic b. In addition, it is possible to specify the abnormal nozzle from the information of the characteristic a and the characteristic c. In the example of FIG. 19, a partial region corresponding to the nozzle number 50 is an example of a "specific partial region". Further, one or a plurality of the nozzle numbers 45 to 49 and the nozzle numbers 51 to 55 is an example of "a partial region subjected to the first correction other than the specific partial region".

In this example, a pattern that is assumed to be virtually abnormal is used for all nozzles, but it is clear from the above that it is not necessary to set the pattern for all nozzles.

About Detection of Streaks Due to Correction State

Up to now, the configuration for specifying the abnormal nozzle has been described, but it is possible to determine streaks due to a correction value, which is not due to the abnormal nozzle. For example, in a case where the streaks are generated only in the nozzle number 50, it can be determined that the abnormal nozzles are not generated, but the correction value of the nozzle number 50 is not an appropriate value (abnormality in the correction value). Determining an abnormality in the correction value is an example of estimating a correction state.

Figure 20:
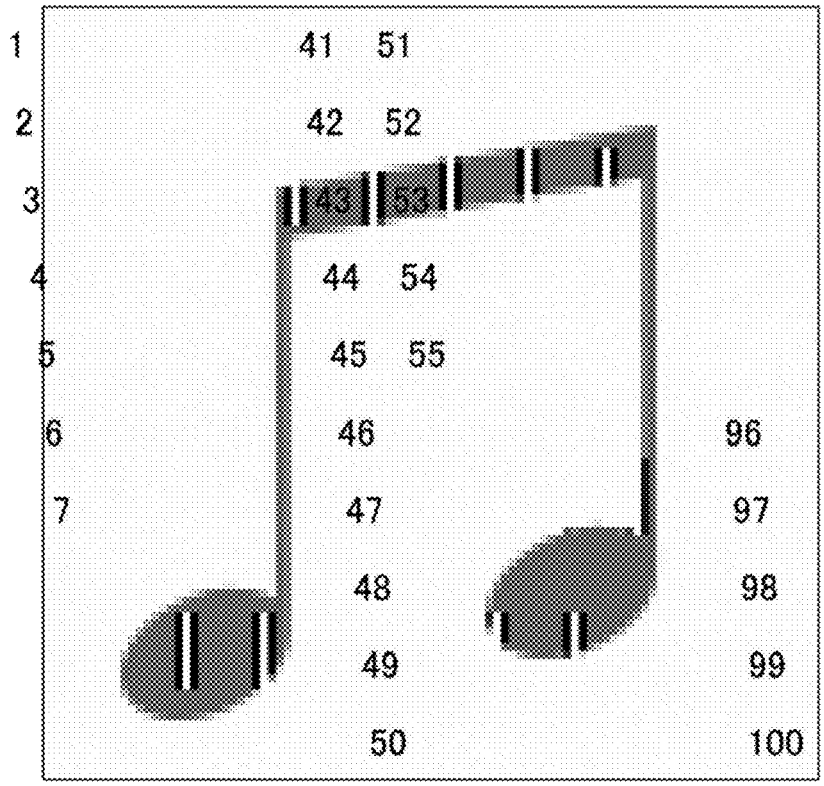
FIG. 20 is an image example in which the abnormal nozzle specifying pattern is embedded in the user image.

About Determination of Presence or Absence of Streaks Using Input Image Information In a case of determining the presence or absence of streaks, it is desirable to refer to input image information. FIG. 20 is an image example in which the abnormal nozzle specifying pattern is embedded in the user image. In FIG. 20, the inspection regions are set as in the example of FIG. 13, but regions corresponding to the nozzle numbers 44 to 52 are a white background, and therefore the nozzle abnormality is not found in these regions. In the user image, regions that originally become a white background are regions in which the nozzles are not substantially inspected, so that the inspection result of the streaks in these regions should be ignored.

The same applies to regions in which the density in the user image is low, and it is desirable to have a configuration that a degree of contribution to the determination of streak detection is changed according to the image density. In particular, it is desirable that the image density is the density after separation to each color plate. It is desirable that the white background region and the low density region in the user image have a relatively low degree of contribution to the determination of streak detection. A gradation value of the pixel in the image data can be used as the density information indicating the image density.

In a case where the inspection region on the user image is small as shown in FIG. 20, there may be a case where the abnormal nozzle may not always be found even in a case where streaks are generated. In such a case, it is desirable to be configured to change the configuration of the inspection region. For example, the configuration of the inspection region can be changed by changing a method of dividing the partial region.

Streak Correction Method and Nozzle Selection Method

Next, a streak correction method will be described. Since it is specified that the nozzle number 50 is abnormal, the streak due to the nozzle number 50 can be made invisible (removal) by replacing printing of the nozzle number 50 with a correction pattern in the entire region of the user image. On the other hand, since nozzles near the nozzle number 50 such as the nozzle number 49 and the nozzle number 51 have been corrected by using the nozzle number 50, a new streak is induced in a case where the data of the input image is simply replaced.

In order to prevent this, it is preferable to have a configuration that the abnormal nozzle specifying pattern is not embedded in the region where the nozzle specified as the abnormal nozzle is used as the correction nozzle.

Figure 21:
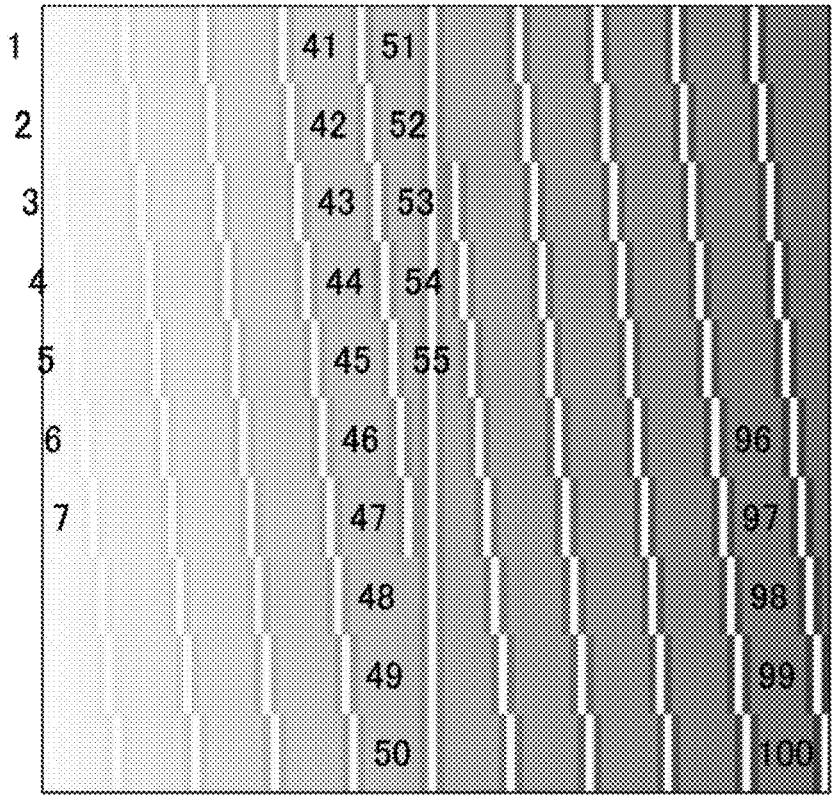
FIG. 21 is an image example in which the abnormal nozzle specifying pattern is embedded in the user image.

For example, in a case where the nozzle number 50 is specified as an abnormal nozzle, as shown in FIG. 21, the abnormal nozzle specifying pattern of the nozzle number 48, the nozzle number 49, the nozzle number 51, and the nozzle number 52 near the nozzle number 50 have a configuration to be not embedded.

As is clear from a comparison between FIG. 21 and FIG. 9, in the example of FIG. 21, the streaks are corrected in entire region of the nozzle number 50, and the embedding of the abnormal nozzle specifying pattern of the nozzle number 48, the nozzle number 49, the nozzle number 51, and the nozzle number 52 is omitted.

As described above, since processing of the streak detection and streak correction in the present embodiment embeds the abnormal nozzle specifying pattern for inspection in the user image designated by the user, in the embedding, it is desirable to print each region by a combination of nozzles in which streaks are not generated.

The "combination of nozzles in which streaks are not generated" indicates a combination of the nozzles that satisfy a condition that the streaks are not generated even in a case where the abnormal nozzle specifying pattern is embedded.

The combination of nozzles satisfying such conditions may be a combination determined in advance or may be a combination defined according to a rule defined in advance.

As an example of a rule for selecting the "combination of nozzles in which streaks are not generated", for example, it is conceivable to select a nozzle under rules such as "do not make a nozzle disabled for ejection continuous in the alignment direction of the nozzles." and/or "do not make the correction nozzle continuous".

In addition to these rules, in the step of determining a correction value for the streak correction, a configuration may be adopted in which the correction is performed assuming an abnormal nozzle, and a combination of nozzles determined that there are no streaks by prior streak inspection performed in advance is used. In a case of determining whether or not there are streaks by the prior streak inspection, a chart different from the user image may be printed and then the determination may be made on the basis of a print result of the chart.

In addition to the method described above, a configuration is also possible in which only the combinations of nozzles for which correction values have been obtained in advance are limited.

Figure 22:
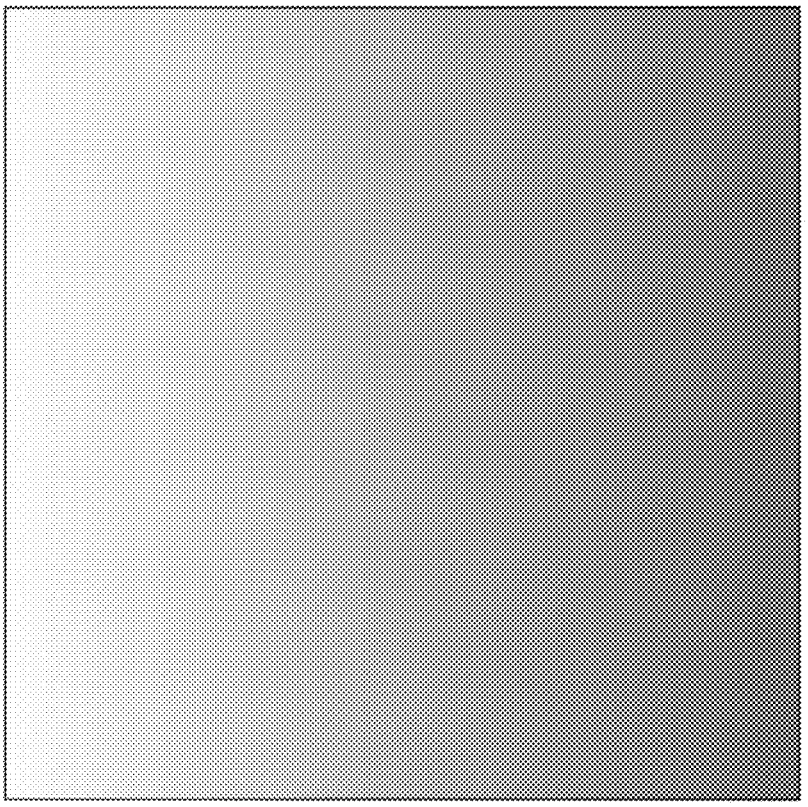
FIG. 22 is an example of an image showing an "appearance" of a print result obtained in a case where the image of FIG. 21 is printed.

FIG. 22 is an "appearance" of a print result obtained in a case where the image of FIG. 21 is printed. Since the abnormal nozzle specifying pattern is embedded by selecting the combination of nozzles in which streaks are not generated, a printed matter without appearance of streaks can be obtained unless the nozzles actually become abnormal.

As described above, even assuming that the configuration in which the embedding of the abnormal nozzle specifying pattern is omitted for some nozzles is adopted, in a case where the nozzle number 48 and the nozzle number 52 are still abnormal, the abnormal nozzle can be specified. This is because these nozzles are used for the correction of the nozzle number 47 and the nozzle number 53, and generate strong streaks at their each position.

On the other hand, it is possible to determine which of the nozzle number 49 and the nozzle number 51 has deteriorated by the deterioration of the correction of the nozzle number 50, but specifically, it is not possible to specify which of them is abnormal from the configuration of the present example.

In the present example, since an option of the correction processing is one type, it is difficult to specify the abnormal nozzle for such a special case, but such a problem can be solved by enabling more kinds of correction processing.

Nozzle Correction Method

In the above description, a method of correcting the abnormal nozzle by using the nozzles near nozzles disabled for ejection is applied, as is widely performed in a single-pass apparatus configuration. Here, examples of applicable correction methods including other nozzle correction methods will be described.

<Case of Single-Pass Configuration>

As a method of the image correction for making streaks invisible, there is known a method of detecting an abnormal nozzle, disabling the abnormal nozzle for ejection, and correcting it by using another nozzle. As a method for correcting such an abnormal nozzle, for example, the method disclosed in JP2010-188663A can be used. That is, it is a method of changing the image density by using a look-up table obtained in advance according to the position of the abnormal nozzle.

As other correction methods, various methods such as a method of changing the size of drops to be used, a method of changing the number of drops, and a method of using other colors can be used.

<Correction by Combination of Redundant Nozzle and Nozzle Distribution Mask>

In a case where a plurality of nozzles can print at the same portion, it is possible to correct the pixel of the abnormal nozzle by printing with an alternative nozzle. A nozzle distribution mask can be used for the allocation of the alternative nozzle.

Figure 23:
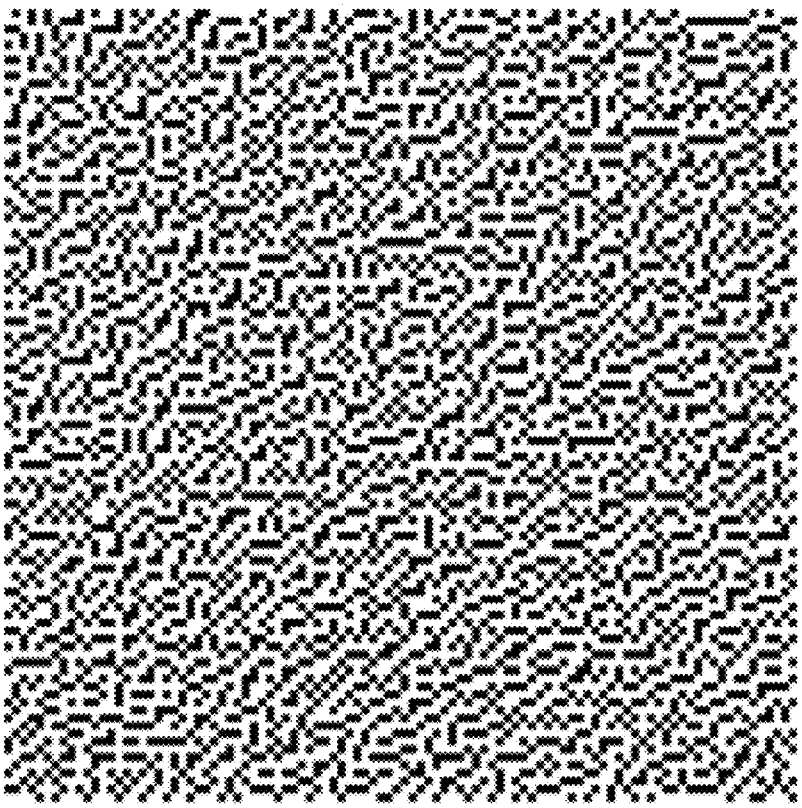
FIG. 23 is a view showing an example of a mask pattern of a nozzle distribution mask.

FIG. 23 is an example of the nozzle distribution mask applied to allocation of used nozzles in a case where printing is performed by using two heads. FIG. 23 shows an image region of 100×100 pixels, and shows that black pixels displayed in black in FIG. 23 are printed by using a nozzle of one head, and white pixels displayed in white are printed by using a nozzle of the other head. The two heads have a common head structure (physical structure).

Figure 24:
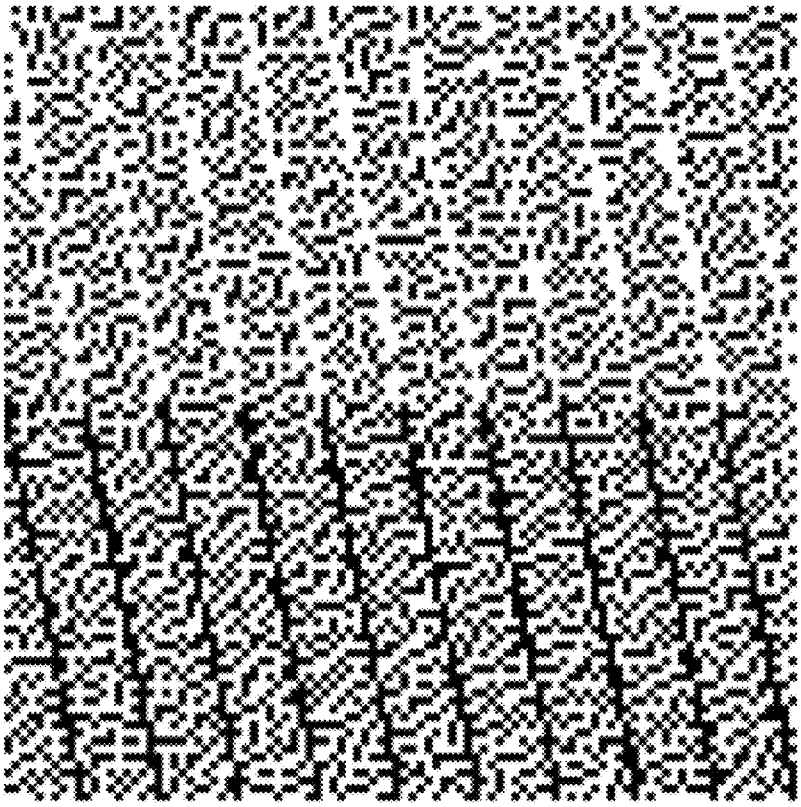
FIG. 24 is a view showing an example of a mask pattern of a nozzle distribution mask used for embedding the abnormal nozzle specifying pattern.
Figure 25:
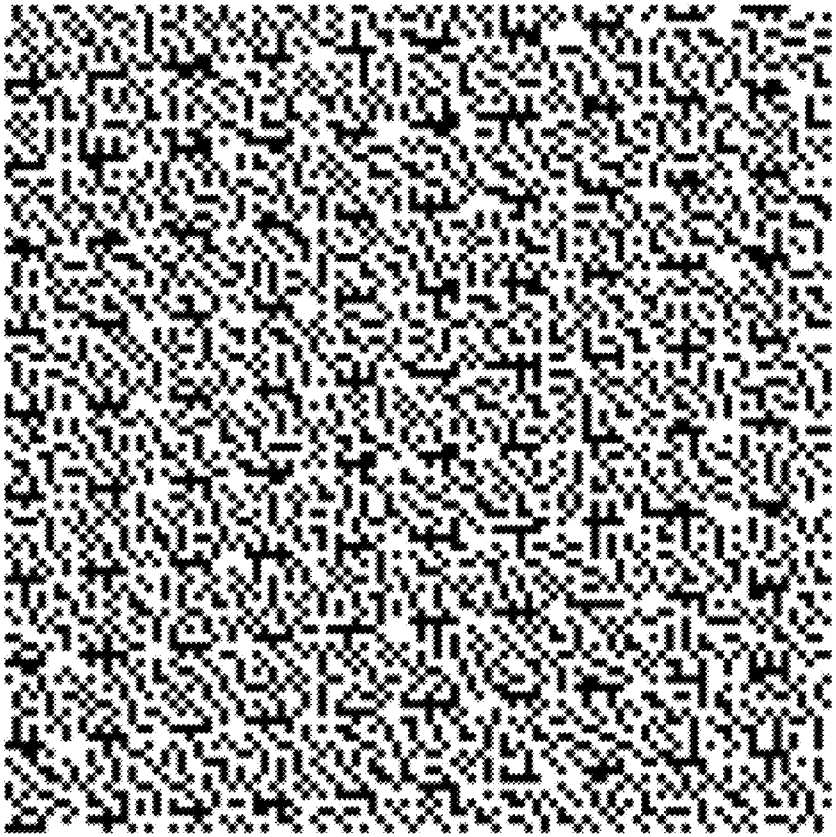
FIG. 25 is a view showing another example of the mask pattern of the nozzle distribution mask used for embedding the abnormal nozzle specifying pattern.

FIGS. 24 and 25 are examples of the nozzle distribution mask used for embedding the abnormal nozzle specifying pattern. The abnormal nozzle specifying pattern can be embedded in the user image by changing a mask pattern of the nozzle distribution mask as shown in FIG. 24 or 25. An information file that describes the mask pattern of the nozzle distribution mask is called a nozzle distribution mask pattern file.

In the nozzle distribution mask shown in FIG. 24, a pattern for detecting an abnormality of each nozzle of a first head for printing the white pixels is embedded in the upper portion of the image in the image region of 100×100 pixels, and a pattern for detecting an abnormality of each nozzle of a second head for printing black pixels is embedded in the lower portion of the image. The nozzle distribution mask shown in FIG. 24 is divided into the upper portion of the image, which is a region of the upper half of FIG. 24, and the lower portion of the image, which is a region of the lower half of FIG. 24, and an abnormal nozzle specifying pattern is unevenly disposed for each head.

However, as shown in FIG. 24, assuming that the disposition of the abnormal nozzle specifying pattern is uneven, in a case where the head moves relatively or the ejection amount changes during printing, there is a concern that a defect of the head is reflected in the print result and is easy to be visualized.

Therefore, as shown in FIG. 25, by distributing the nozzle inspection regions of each head in the image region, it is possible to detect the abnormality of the nozzle while making the abnormality that should not be visualized unnoticeable.

In the nozzle distribution mask shown in FIG. 25, the nozzle inspection region of each head is dispersed such that the nozzle inspection region of the first head in which the pattern for detecting the abnormality of each nozzle of the first head for printing white pixels is disposed and the nozzle inspection region of the second head in which the pattern for detecting the abnormality of each nozzle of the second head for printing black pixels is disposed are alternately changed along the paper transport direction.

In a case where the correction unit 42 described in FIG. 1 performs correction by using the nozzle distribution mask, the nozzle distribution mask pattern file is updated every time an abnormal nozzle is specified.

<Correction to Replace with Other Colors>

The correction for the abnormal nozzle is not limited to the correction by using nozzles having the same color as the abnormal nozzle, and may be performed by using nozzles having a different color from the abnormal nozzle. For example, the technique of the present invention can be applied to correction for replacing an abnormal nozzle of K color with CMY composite black.

Structural Example of Inkjet Printing Apparatus

Figure 26:
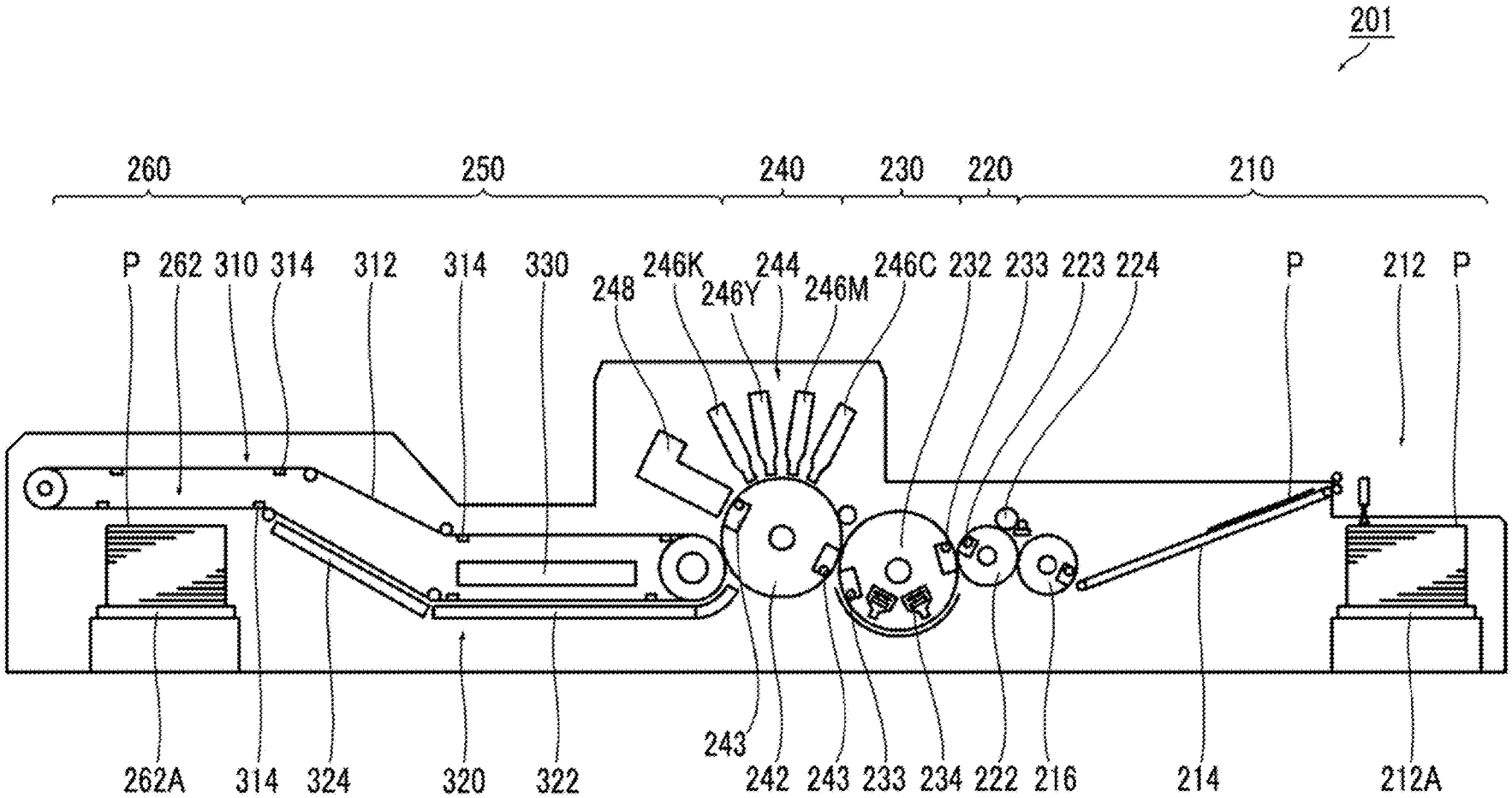
FIG. 26 is a side view showing a configuration example of an inkjet printing apparatus.

FIG. 26 is a side view showing a configuration of an inkjet printing apparatus 201. The inkjet printing apparatus 201 shown in FIG. 26 is an example of the inkjet printing apparatus main body 11 shown in FIG. 1.

The inkjet printing apparatus 201 is a single-pass inkjet printing apparatus that forms a color image on a sheet paper P. The inkjet printing apparatus 201 comprises a paper feeding unit 210, a treatment liquid application unit 220, a treatment liquid drying unit 230, a drawing unit 240, an ink drying unit 250, and a stacking unit 260.

The paper feeding unit 210 automatically feeds the paper P one by one. The paper feeding unit 210 comprises a paper feeding apparatus 212, a feeder board 214, and a paper feeding drum 216. The type of the paper P is not particularly limited, and for example, print paper mainly composed of cellulose such as high-quality paper, coated paper, art paper, and the like can be used. The paper P corresponds to one form of a medium on which an image is recorded. The paper P is placed on a paper feeding table 212A in a state of a stack in which a large number of papers are laminated.

The paper feeding apparatus 212 takes out the paper P in the state of the stack set on the paper feeding table 212A one by one from the top and feeds them to the feeder board 214. The feeder board 214 transfers the paper P received from the paper feeding apparatus 212 to the paper feeding drum 216.

The paper feeding drum 216 receives the paper P fed from the feeder board 214, and transfers the received paper P to the treatment liquid application unit 220.

The treatment liquid application unit 220 applies a treatment liquid to the paper P. The treatment liquid is a liquid comprising a function of aggregating, insolubilizing or thickening a coloring material component in an ink. The treatment liquid application unit 220 comprises a treatment liquid application drum 222 and a treatment liquid application apparatus 224.

The treatment liquid application drum 222 receives the paper P from the paper feeding drum 216, and transfers the received paper P to the treatment liquid drying unit 230. The treatment liquid application drum 222 comprises a gripper 223 on a peripheral surface thereof, and the paper P is wound around the peripheral surface and transported by gripping and rotating the distal end portion of the paper P by the gripper 223.

The treatment liquid application apparatus 224 applies the treatment liquid to the paper P transported by the treatment liquid application drum 222. The treatment liquid is applied by rollers.

The treatment liquid drying unit 230 dries the paper P coated with the treatment liquid. The treatment liquid drying unit 230 comprises a treatment liquid drying drum 232 and a warm air blower 234. The treatment liquid drying drum 232 receives the paper P from the treatment liquid application drum 222, and transfers the received paper P to the drawing unit 240. The treatment liquid drying drum 232 comprises a gripper 233 on the peripheral surface. The treatment liquid drying drum 232 transports the paper P by gripping and rotating the distal end portion of the paper P with the gripper 233.

The warm air blower 234 is disposed inside the treatment liquid drying drum 232. The warm air blower 234 blows warm air on the paper P transported by the treatment liquid drying drum 232 to dry the treatment liquid.

The drawing unit 240 comprises a drawing drum 242, a head unit 244, and an in-line scanner 248. The drawing drum 242 receives the paper P from the treatment liquid drying drum 232, and transfers the received paper P to the ink drying unit 250. The drawing drum 242 comprises a gripper 243 on a peripheral surface thereof, and the paper P is wound around the peripheral surface and transported by gripping and rotating the distal end portion of the paper P by the gripper 243. The drawing drum 242 comprises an adsorption mechanism (not shown), and adsorbs the paper P wound around the peripheral surface onto the peripheral surface to transport the paper P. Negative pressure is used for adsorption. The drawing drum 242 comprises a large number of adsorption holes on the peripheral surface, and causes the paper P to be absorbed on the peripheral surface by sucking from the inside via the adsorption holes.

The head unit 244 comprises inkjet heads 246C, 246M, 246Y, and 246K. Each of the inkjet heads 246C, 246M, 246Y, and 246K corresponds to the print head 16 described in FIG. 1.

The inkjet head 246C is a recording head that ejects a liquid droplet of cyan (C) ink. The inkjet head 246M is a recording head that ejects a liquid droplet of magenta (M) ink. The inkjet head 246Y is a recording head that ejects a liquid droplet of yellow (Y) ink. The inkjet head 246K is a recording head that ejects a liquid droplet of black (K) ink. Ink is supplied to each of the inkjet heads 246C, 246M, 246Y, and 246K from an ink tank (not shown) that is an ink supply source of a corresponding color via a pipe path (not shown).

Each of the inkjet heads 246C, 246M, 246Y, and 246K is composed of a line head corresponding to a paper width, and each nozzle surface is disposed so as to face the peripheral surface of the drawing drum 242. The paper width used herein indicates a paper width in a direction orthogonal to the transport direction of the paper P. The inkjet heads 246C, 246M, 246Y, and 246K are disposed at regular intervals along the transport path of the paper P by the drawing drum 242.

Although not shown in the drawing, a plurality of nozzles, which are ink ejection ports, are two-dimensionally arranged on the nozzle surface of each of the inkjet heads 246C, 246M, 246Y, and 246K. The "nozzle surface" means an ejection surface on which nozzles are formed, and is synonymous with the terms "ink ejection surface" or "nozzle formation surface". A nozzle array of a plurality of two-dimensionally arranged nozzles is called a "two-dimensional nozzle array".

Each of the inkjet heads 246C, 246M, 246Y, and 246K can be configured by connecting a plurality of head modules in the paper width direction. Each of the inkjet heads 246 C, 246 M, 246 Y, and 246 K is a full-line type print head having a nozzle row capable of forming an image with a defined recording resolution by one scanning of the entire recording region of the paper P in the paper width direction orthogonal to the transport direction of the paper P. The full-line type print head is also called a page wide head. The defined recording resolution may be a recording resolution defined in advance by the inkjet printing apparatus 201, or a recording resolution set by user's selection or automatic selection by a program corresponding to a printing mode. The recording resolution can be set to 1200 dpi, for example. The paper width direction orthogonal to the paper P transport direction may be referred to as the nozzle row direction of the line head, and the transport direction of the paper P may be referred to as the nozzle row vertical direction.

In a case of an inkjet head having the two-dimensional nozzle array, a projection nozzle row obtained by projecting (orthogonal projection) each nozzle in the two-dimensional nozzle array so as to be aligned along the nozzle row direction can be considered to be equivalent to one nozzle row in which the nozzles are aligned at approximately equal intervals in a nozzle density for achieving the maximum recording resolution in the nozzle row direction. The "approximately equal intervals" means that jetting points that can be recorded by the inkjet printing apparatus are substantially equal intervals. For example, the concept of "equal interval" includes a case where the interval is slightly different in consideration of manufacturing errors and/or the movement of the liquid droplet on the medium by landing interference. The projection nozzle row corresponds to a substantial nozzle row. Considering the projection nozzle row, it is possible to associate each nozzle with a nozzle number representing a nozzle position in the alignment order of the projection nozzles aligned along the nozzle row direction. The term "nozzle position" may indicate the position of the nozzle in this substantial nozzle row. In a case of expressing a positional relationship between nozzles such as adjacent nozzles or near nozzles, the positional relationship in the "substantial nozzle row" described above is represented. Assuming that the nozzle alignment direction of the substantial nozzle row is the x-axis direction, the nozzle position can be represented as an x coordinate, and thus the nozzle position can be associated with a position in the x direction (x coordinate).

The arrangement form of the nozzles in each of the inkjet heads 246C, 246M, 246Y, and 246K is not limited, and various nozzle arrangement forms can be adopted. For example, instead of a two-dimensional matrix array, a linear array in one row, a V-shaped nozzle array, a W-shaped nozzle array having the V-shaped array as a repeating unit, or a zigzag nozzle array may be used.

Liquid droplets of the ink are ejected from the inkjet heads 246C, 246M, 246Y, and 246K toward the paper P transported by the drawing drum 242, and the ejected liquid droplets adhere to the paper P, whereby an image is recorded on the paper P.

Figure 27:
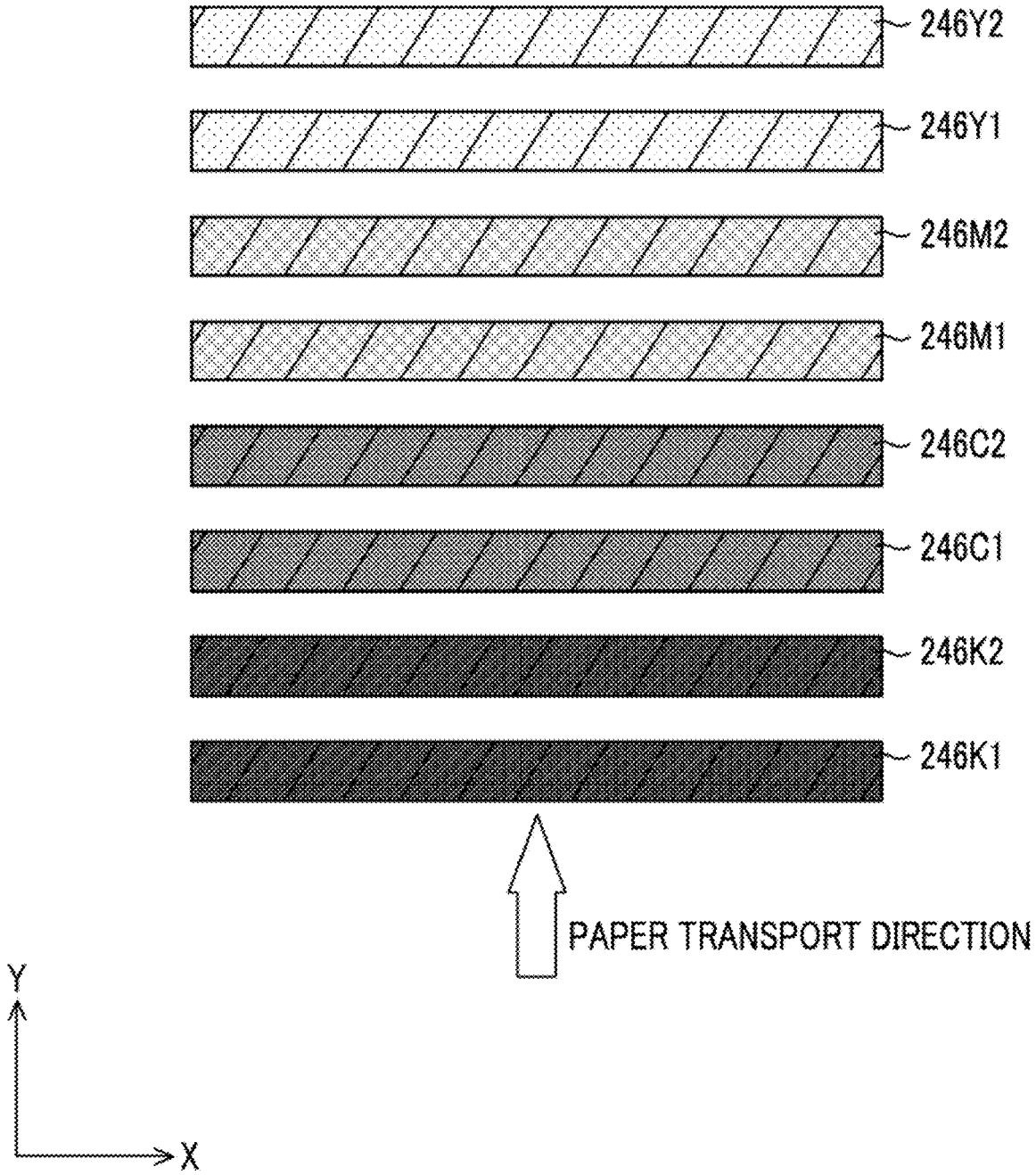
FIG. 27 is a plan view showing an example of forms of disposition of print heads in an image forming apparatus comprising two print heads that eject the same color ink for each color of ink.

The drawing drum 242 functions as means for relatively moving the inkjet heads 246C, 246M, 246Y, 246K and the paper P. The drawing drum 242 relatively moves the paper P with respect to the inkjet heads 246C, 246M, 246Y, and 246K, and corresponds to one form of relative moving means. An ejection timing of each of the inkjet heads 246C, 246M, 246Y, and 246K is synchronized with a rotary encoder signal obtained from a rotary encoder arranged on the drawing drum 242. In FIG. 27, the illustration of the rotary encoder is omitted. The ejection timing is timing of ejecting liquid droplets of the ink and is synonymous with a jetting timing.

The configuration of the CMYK standard color (4 colors) has been illustrated in this example, but combinations of the ink color and the number of colors are not limited to this embodiment, and a light ink, a dark ink, a special color ink, or the like may be added as necessary. For example, it is possible to be configured to add an inkjet head for ejecting the light ink such as light cyan or light magenta, or to add an inkjet head for ejecting the special color ink such as green or orange, and the arrangement order of the inkjet heads of each color is not particularly limited.

The in-line scanner 248 is an image readout apparatus that reads an image recorded on the paper P by the inkjet heads 246C, 246M, 246Y, and 246K. The in-line scanner 248 is composed of using, for example, a CCD line sensor. The in-line scanner 248 includes an illumination optical system (not shown). The in-line scanner 248 corresponds to the scanner 18 described in FIG. 1.

An image abnormality is detected on the basis of the readout image data read by the in-line scanner 248. In addition, on the basis of the data of the readout image read by the in-line scanner 248, information such as image density and ejection abnormality of the inkjet heads 246C, 246M, 246Y, and 246K can be obtained.

The ink drying unit 250 dries the paper P on which the image is recorded by the drawing unit 240. The ink drying unit 250 comprises a chain delivery 310, a paper guide 320, and a warm air blowing unit 330.

The chain delivery 310 receives the paper P from the drawing drum 242, and transfers the received paper P to the stacking unit 260. The chain delivery 310 comprises a pair of endless chains 312 that travel on a defined traveling path, and grips the distal end portion of the paper P with a gripper 314 comprised in the pair of chains 312, and then transports the paper P along a defined transport path. A plurality of grippers 314 is comprised at regular intervals in the chain 312.

The paper guide 320 is a member that guides the transport of the paper P by the chain delivery 310. The paper guide 320 is composed of a first paper guide 322 and a second paper guide 324. The first paper guide 322 guides the paper P transported in the first transport section of the chain delivery 310. The second paper guide 324 guides the paper P transported in the second transport section subsequent to the first transport section. The warm air blowing unit 330 blows warm air to the paper P transported by the chain delivery 310.

The stacking unit 260 comprises a stacking apparatus 262 that receives and stacks the paper P transported from the ink drying unit 250 by the chain delivery 310.

The chain delivery 310 releases the paper P at a predetermined stacking position. The stacking apparatus 262 comprises a stacking tray 262A, receives the paper P released from the chain delivery 310, and stacks the paper P on the stacking tray 262A in a bundle. The stacking unit 260 corresponds to the paper discharging unit.

A paper transport system including the paper feeding drum 216, the drawing drum 242, and the chain delivery 310 corresponds to the paper transport mechanism 14 described in FIG. 1.

Configuration Comprising Redundant Nozzle

FIG. 27 is a plan view showing an example of forms of disposition of print heads in an image forming apparatus comprising two print heads that eject the same color ink for each color of ink. For example, an image forming apparatus using inks of four colors of cyan (C), magenta (M), yellow (Y), and black (K) comprises, as shown in FIG. 27, two print heads 246 K1, 246 K2, 246 C1, 246 C2, 246 M1, 246 M2, 246 Y1, and 246 Y2 for each color. Each head can have a common structure.

The number of colors of ink (the number of color types) and the arrangement order of the print heads are not particularly limited. Nozzles used for ejecting droplets are selected for each pixel according to the nozzle distribution mask pattern file for each color of ink.

Hardware Configuration of Each Portion in Control Apparatus

The hardware structure of the processing unit which executes various processing such as the system controller 20, the image processing unit 28, the image inspection unit 30, the transport control unit 32, the printing control unit 34, the association unit 40, the abnormal nozzle specifying pattern embedding processing unit 41, the correction unit 42, the streak detection unit 44, and the nozzle state estimation unit 46 shown in FIG. 1 is various processors as follows.

The various processors include a central processing unit (CPU) as a general-purpose processor functioning as various processing units by executing a program, a programmable logic device (PLD) as a processor of which the circuit configuration can be changed after manufacturing such as a field programmable gate array (FPGA), and a dedicated circuitry which is a processor having a circuit configuration specifically designed to execute specific processing such as an application specific integrated circuit (ASIC).

One processing unit may be configured with one of these various processors, or may be configured with two or more same kind or different kinds of processors. For example, one processing unit may be configured with a plurality of FPGAs, or a combination of CPU and FPGA. In addition, a plurality of processing units may be configured by one processor. As an example where the plurality of processing units is configured with one processor, first, there is an aspect where one processor is configured with a combination of one or more CPUs and software as represented by a computer such as a client or a server, and functions as a plurality of processing units. Second, as represented by a system on chip (SoC), there is an aspect in which a processor that realizes the functions of the entire system including the plurality of processing units by one integrated circuit (IC) chip is used. In this way, various processing units are configured by using one or more of the above-described various processors as hardware structures.

In addition, the hardware structures of these various processors are, more specifically, a circuitry where circuit elements such as semiconductor elements are combined.

Advantages of Embodiment

According to the embodiment of the present invention, there are the following advantages.

(1) It is possible to detect streaks from a single user image region and specify an abnormal nozzle causing the streaks. According to the present embodiment, it is possible to specify the abnormal nozzle causing the streak from the same one image (one page image) that is the image itself in which the streak is detected.

(2) Since it is not necessary to separately provide a dedicated nozzle inspection region outside the user image region, it is possible to suppress the consumption of extra medium. In addition, it is possible to simplify the post-processing step of removing the nozzle inspection region outside the user image region after printing.

(3) In a case where streaks are generated in the print image, the streaks can be corrected early without increasing the amount of waste paper.

Modification Example 1

In the above-described embodiment, the user image is divided into a plurality of partial regions and the respective partial regions are associated with the nozzles. However, in the practice of the present invention, the step of dividing the user image into a plurality of partial regions is not always necessary. It is only necessary to grasp a correspondence relationship between a region in the image and the nozzle corresponding to the region.

Modification Example 2

In the above-described embodiment, the function of specifying the abnormal nozzle from the print result of the user image and correcting the abnormal nozzle has been described, but actions after the abnormal nozzle is specified may include operations other than the correction. The operations other than the correction may include, for example, maintenance processing for recovering ejection performance of the abnormal nozzle, processing for determining whether or not head replacement is required, marking processing for the abnormal portion, and control of the subsequent step in consideration of the abnormal portion.

Modification Example 3

In the above embodiment, an aspect in which the signal value is corrected by applying the correction value to the image data before the halftone processing, and the image data after the correction is subjected to the halftone processing is illustrated, but in the practice of the present invention, a configuration for correcting the data after the halftone processing may be adopted. In addition, a drive signal applied to an ejection energy generating element of each nozzle may be corrected.

Modification Example 4

The image forming apparatus comprising the scanner 18 is illustrated in the above-described embodiment, but the image readout apparatus for reading the print result may be an externally attached external apparatus.

About Transport Mechanism of Medium

A medium transport mechanism for transporting the medium is not limited to a drum transport system, and various types of mechanisms such as an adsorption belt transport system, a nip transport system, a chain transport system, and a pallet transport system can be adopted. In addition, in a case where a continuous medium is used, a so-called roll-to-roll type transport mechanism such as a web transport system is used. In a case of using the continuous medium, a medium support surface may be a surface of a platen that supports the medium.

About Medium

The term "medium" is a generic name for various terms such as paper, recording paper, printing paper, a recording medium, a press medium, a copy medium, a printed medium, an image forming medium, an image formed medium, an image receiving medium, an ejected medium, or the like. The material and shape of the medium are not particularly limited, and various sheet bodies can be used regardless of the material and shape of seal paper, a resin sheet, a film, a cloth, a non-woven fabric, or the like. The medium is not limited to a sheet medium, and may be a continuous medium such as continuous paper. In addition, the sheet medium is not limited to a cut sheet that is prepared to a size defined in advance, and may be obtained by cutting the continuous medium into a defined size at any time.

In a case where the continuous medium is used, the concept of "one image" or "single image" indicates a unit of one section of the user image region formed for each different region of the continuous medium.

About Ejection System

An ejector of the inkjet head is configured to include a nozzle that ejects a liquid, a pressure chamber that communicates with the nozzle, and the ejection energy generating element that applies ejection energy to the liquid in the pressure chamber. Regarding the ejection system of ejecting liquid droplets from the nozzle of the ejector, a means for generating ejection energy is not limited to a piezoelectric element, and various ejection energy generating elements such as a heating element and an electrostatic actuator can be applied. For example, it is possible to adopt a method of ejecting the liquid droplets by using a pressure of membrane boiling due to the heating of the liquid by the heating element. Corresponding ejection energy generating elements are provided in a flow path structure according to the ejection system of the liquid ejection head.

About Combinations of Embodiment and Modification Example

The items described in the configurations and the modification examples described in the above-described embodiment can be appropriately combined and used, and some items can be replaced.

Application Example of Image Forming Apparatus

In the above-described embodiment, an example of the inkjet printing apparatus for graphic printing is described, but the scope of application of the present invention is not limited to this example. The image formed by the image forming apparatus is not limited to an image formed by using an ink containing a color material, and may be an image formed of other functional material such as a treatment liquid applied to the paper before applying the ink and/or a varnish applied to the paper after applying the ink. For example, the present invention can be widely applied to an image forming apparatus for forming various shapes and patterns by using a liquid functional material (liquid), such as a wiring drawing apparatus for drawing a wiring pattern of an electronic circuit, a manufacturing apparatus for various devices, a resist printing apparatus using a resin liquid as a functional liquid for ejection, a color filter manufacturing apparatus, and a fine structure forming apparatus for forming a fine structure using a material deposition material.

In the embodiment of the present invention described above, it is possible to appropriately change, add, or delete the constituent elements without departing from the spirit of the present invention. The present invention is not limited to the embodiments described above, and many deformations can be made by a person having ordinary knowledge in the field within the technical idea of the present invention.

EXPLANATION OF REFERENCES

10: image forming apparatus
11: inkjet printing apparatus main body
12: control apparatus
14: paper transport mechanism
16: print head
18: scanner
20: system controller
22: communication unit
24: display apparatus
26: input apparatus
28: image processing unit
30: image inspection unit
32: transport control unit
34: printing control unit
40: association unit
41: abnormal nozzle specifying pattern embedding processing unit
42: correction unit
44: streak detection unit
46: nozzle state estimation unit
201: inkjet printing apparatus
210: paper feeding unit
212: paper feeding apparatus
212A: paper feeding table
214: feeder board
216: paper feeding drum
220: treatment liquid application unit
222: treatment liquid application drum
223: gripper
224: treatment liquid application apparatus
230: treatment liquid drying unit
232: treatment liquid drying drum
233: gripper
234: warm air blower
240: drawing unit
242: drawing drum
243: gripper
244: head unit
246C, 246M, 246Y, 246K: inkjet head
246C1, 246C2, 246M1, 246M2: print head
246Y1, 246Y2, 246K1, 246K2: print head
248: in-line scanner
250: ink drying unit
260: stacking unit
262: stacking apparatus
262A: stacking tray
310: chain delivery
312: chain
314: gripper
320: paper guide
322: first paper guide
324: second paper guide
330: warm air blowing unit
400: print image
402: streak
410: input image
412: nozzle check pattern
P: paper
S11 to S20: steps of image forming method

What is claimed is:

1. An image forming apparatus comprising:
a print head that has a plurality of nozzles for ejecting a liquid droplet;
an association unit that associates the nozzle with a partial region in a user image designated as an image of a target whose image is formed by using the print head;
a first correction unit that performs a first correction assuming that the associated nozzle is abnormal in at least one of the partial regions;
a printing control unit that causes the print head to print the user image including the partial region subjected to the first correction;
a streak detection unit that detects streak information from a print result of the user image including the partial region subjected to the first correction; and
a nozzle state estimation unit that estimates a state of the nozzle on the basis of the streak information of two or more partial regions in a single user image printed by using the print head.

2. The image forming apparatus according to claim 1, further comprising:
a second correction unit that performs a second correction that suppresses a visibility of streaks due to an abnormal nozzle having an ejection abnormality on the basis of the state of the nozzle estimated by the nozzle state estimation unit.

3. The image forming apparatus according to claim 2,
wherein the second correction unit disables the abnormal nozzle for ejection and performs the second correction by using a nozzle near the abnormal nozzle.

4. The image forming apparatus according to claim 3, further comprising:
an information storage unit that stores an abnormal nozzle mask file that describes information on the abnormal nozzle disabled for ejection,
wherein the abnormal nozzle mask file is updated in a case where the abnormal nozzle is newly specified by the nozzle state estimation unit.

5. The image forming apparatus according to claim 2,
wherein a plurality of heads that is capable of printing in the same region is provided as the print head,
wherein the nozzle used for printing each pixel is selected by using a nozzle distribution mask pattern file that defines which nozzle of the plurality of heads is used to print each pixel, and
wherein the second correction unit performs the second correction by updating the nozzle distribution mask pattern file.

6. The image forming apparatus according to claim 2, wherein the second correction unit replaces a color of an abnormal nozzle determined to be abnormal by the nozzle state estimation unit with a different color and performs the second correction by using another nozzle of the different color.

7. The image forming apparatus according to claim 1, wherein the association unit divides a single region of the user image into a plurality of the partial regions, and associates the nozzle with each of the divided partial regions.

8. The image forming apparatus according to claim 1, wherein among the plurality of nozzles, a combination of the nozzles that is assumed to be abnormal in the partial region is a combination determined in advance by satisfying a condition that streaks are not generated by performing the first correction.

9. The image forming apparatus according to claim 1, wherein among the plurality of nozzles, a combination of the nozzles that is assumed to be abnormal in the partial region is a combination of the nozzles determined that there are no streaks in a streak inspection performed in advance.

10. The image forming apparatus according to claim 9, wherein the determination that there are no streaks is made by using a chart printed separately from the user image.

11. The image forming apparatus according to claim 1, wherein among the plurality of nozzles, a combination of the nozzles that is assumed to be abnormal in the partial region is set according to information on the abnormal nozzle already specified and a rule defined in advance.

12. The image forming apparatus according to claim 1, wherein the nozzle state estimation unit uses density information of an input image representing the user image for the estimation, and lowers a degree of contribution to the estimation with respect to a region having a relatively low image density in the input image.

13. The image forming apparatus according to claim 1, wherein the nozzle state estimation unit estimates the state of the nozzle by using information indicating an intensity of a streak.

14. The image forming apparatus according to claim 1, wherein the nozzle state estimation unit estimates a correction state in addition to estimation of the state of the nozzle.

15. The image forming apparatus according to claim 1, wherein the nozzle state estimation unit determines that the correction nozzle is abnormal in a case where streaks are generated in the plurality of partial regions that shares a correction nozzle used for a correction of the assumed abnormal nozzle in the first correction.

16. The image forming apparatus according to claim 1, wherein in a case where there are no streaks in a specific partial region subjected to the first correction and there are streaks in the partial region subjected to the first correction other than the specific partial region, the nozzle state estimation unit determines that the nozzle assumed to be abnormal in the specific partial region actually becomes abnormal.

17. The image forming apparatus according to claim 1, wherein a combination of the nozzles associated with the partial region is changed in a case where the nozzle state estimation unit cannot specify an abnormal nozzle.

18. The image forming apparatus according to claim 1, wherein the assumed abnormal nozzle in the first correction unit is set to different partial regions in different colors.

19. The image forming apparatus according to claim 1, wherein a plurality of heads that has a common structure is provided as the print head, and wherein the partial regions where the assumed abnormal nozzle in the first correction unit is set for each of the plurality of heads are set at dispersed positions in the user image.

20. The image forming apparatus according to claim 1, wherein the first correction unit performs processing of embedding a correction pattern subjected to the first correction in the partial region in the user image.

21. The image forming apparatus according to claim 1, further comprising:

an image readout apparatus that reads the print result of the user image printed by using the print head; and a signal processing apparatus that processes a readout image acquired by using the image readout apparatus, wherein the signal processing apparatus performs processing as the streak detection unit and the nozzle state estimation unit.

22. A printed matter manufacturing method for manufacturing a printed matter on which a user image is formed, the method comprising:

printing the user image including the partial region subjected to the first correction by using the image forming apparatus according to any claim 1.

23. An image forming method for forming an image by using a print head that has a plurality of nozzles for ejecting a liquid droplet, the method comprising:

a step of associating the nozzle with a partial region in a user image designated as an image of a target whose image is formed;

a step of performing a first correction assuming that the associated nozzle is abnormal in at least one of the partial regions;

a step of causing the print head to print the user image including the partial region subjected to the first correction;

a step of detecting streak information from a print result of the user image including the partial region subjected to the first correction; and a step of estimating a state of the nozzle on the basis of the streak information of two or more partial regions in a single user image printed by using the print head.

24. An abnormal nozzle detection method for detecting an abnormal nozzle of a print head that has a plurality of nozzles for ejecting a liquid droplet, the method comprising:

a step of associating the nozzle with a partial region in a user image designated as an image of a target whose image is formed;

a step of performing a first correction assuming that the associated nozzle is abnormal in at least one of the partial regions;

a step of causing the print head to print the user image including the partial region subjected to the first correction;

a step of detecting streak information from a print result of the user image including the partial region subjected to the first correction; and a step of estimating a state of the nozzle on the basis of the streak information of two or more partial regions in a single user image printed by using the print head.

* * * * *